US010100555B2

(12) United States Patent
Adolfsson

(10) Patent No.: US 10,100,555 B2
(45) Date of Patent: Oct. 16, 2018

(54) LOCK AND BINARY KEY THEREFOR

(76) Inventor: Bernt Adolfsson, Ljungby (SE)

( * ) Notice: Subject to any disclaimer, the term of this patent is extended or adjusted under 35 U.S.C. 154(b) by 147 days.

(21) Appl. No.: 13/142,619

(22) PCT Filed: Jan. 19, 2010

(86) PCT No.: PCT/SE2010/050047
§ 371 (c)(1),
(2), (4) Date: Jul. 25, 2011

(87) PCT Pub. No.: WO2010/085205
PCT Pub. Date: Jul. 29, 2010

(65) Prior Publication Data

US 2011/0271722 A1 Nov. 10, 2011

(30) Foreign Application Priority Data

Jan. 19, 2009 (SE) ..... 0900050

(51) Int. Cl.
*E05B 29/02* (2006.01)
*E05B 19/18* (2006.01)
(Continued)

(52) U.S. Cl.
CPC ..... *E05B 29/00* (2013.01); *E05B 19/18* (2013.01); *E05B 29/0013* (2013.01);
(Continued)

(58) Field of Classification Search
CPC ..... Y10T 70/7057; Y10T 70/7486; Y10T 70/7842; Y10T 70/7843; E05B 29/00;
(Continued)

(56) References Cited

U.S. PATENT DOCUMENTS 316,132 A * 4/1885 Doubler ..... 70/143
939,679 A * 11/1909 Freud ..... 70/411
(Continued)

FOREIGN PATENT DOCUMENTS

AU 679163 B 6/1997
CH 281686 A 3/1952
(Continued)

OTHER PUBLICATIONS

English language translation of Office Action (Notice of Reasons for Rejection) dated Sep. 17, 2013, issued by the Japanese Patent Office in the corresponding Japanese Patent Application No. 2011-546233. (2 pages).

(Continued)

*Primary Examiner* — Lloyd A Gall
(74) *Attorney, Agent, or Firm* — Davis & Bujold PLLC; Michael J. Bujold

(57) ABSTRACT

An arrangement for a lock is provided, comprising a stator, a rotor, which is rotatably arranged in the stator, and a set of elements arranged in the rotor for cooperating with the stator, which elements each have an opening and which elements are arranged successively in the longitudinal direction of the rotor and the openings of which together form a through hole for receiving a key, each of the elements being readjustably arranged, independently of each other, between a state which upon actuation is blocking and a state which upon the same actuation is releasing. The disclosure further concerns a key, which has a body along which a plurality of projections are arranged, the plurality of projections all being arranged in a common plane and the plurality of projections all having the same height and defining together the profile of the key.

4 Claims, 24 Drawing Sheets

(51) Int. Cl.

| | |
|---|---|
| ***E05B 29/00*** | (2006.01) |
| ***E05B 47/06*** | (2006.01) |
| *E05B 9/04* | (2006.01) |
| *E05B 9/08* | (2006.01) |
| *E05B 47/00* | (2006.01) |
| *E05B 63/00* | (2006.01) |
| *E05B 65/44* | (2006.01) |

(52) U.S. Cl.
CPC ..... *E05B 47/063* (2013.01); *E05B 9/045* (2013.01); *E05B 9/08* (2013.01); *E05B 29/004* (2013.01); *E05B 47/0002* (2013.01); *E05B 63/006* (2013.01); *E05B 65/44* (2013.01); *E05B 2047/0095* (2013.01); *Y10T 70/7057* (2015.04); *Y10T 70/7486* (2015.04); *Y10T 70/7842* (2015.04)

(58) Field of Classification Search
CPC .... E05B 47/063; E05B 19/18; E05B 29/0013; E05B 65/44; E05B 63/006; E05B 2047/0095; E05B 9/045; E05B 9/08; E05B 47/0002; E05B 29/004
USPC ..... 70/409, 411, 492, 367, 369, 368, 371
See application file for complete search history.

(56) References Cited

U.S. PATENT DOCUMENTS

| | | | | | |
|---|---|---|---|---|---|
| 1,022,900 | A | * | 4/1912 | Von Vargyas | 70/411 |
| 1,107,376 | A | * | 8/1914 | Thiman | 70/492 |
| 1,148,526 | A | * | 8/1915 | Muscarella | 70/312 |
| 1,161,151 | A | * | 11/1915 | Muscarella | 70/312 |
| 1,406,573 | A | * | 2/1922 | Mantanfel | 70/492 |
| 1,446,760 | A | * | 2/1923 | Miller | 70/34 |
| 1,537,049 | A | * | 5/1925 | Vives | 70/411 |
| 1,565,557 | A | | 12/1925 | Fremon | |
| 1,644,365 | A | * | 10/1927 | Bennett | 70/492 |
| 1,826,615 | A | * | 10/1931 | Hansen et al. | 70/411 |
| 2,006,374 | A | * | 7/1935 | Voges | 70/393 |
| RE20,143 | E | * | 10/1936 | Gray | 70/492 |
| 2,243,963 | A | * | 6/1941 | Kleinknecht | 341/173 |
| 2,301,755 | A | * | 11/1942 | Seiffert | 70/355 |
| 2,356,891 | A | * | 8/1944 | Seiffert | 70/411 |
| 2,430,913 | A | * | 11/1947 | Ciani | 70/355 |
| 2,430,914 | A | * | 11/1947 | Ciani | 70/411 |
| 2,647,391 | A | * | 8/1953 | Uher | 70/492 |
| 3,170,317 | A | * | 2/1965 | Parlier | 70/492 |
| 3,208,248 | A | * | 9/1965 | Tornoe | 70/383 |
| 3,243,979 | A | * | 4/1966 | Silvern | 70/411 |
| 3,439,516 | A | * | 4/1969 | Quillen | 70/383 |
| 3,665,740 | A | | 5/1972 | Taniyama | |
| 3,789,638 | A | | 2/1974 | Roberts et al. | |
| 3,810,416 | A | * | 5/1974 | Nelms, Jr. | 409/130 |
| 4,103,525 | A | * | 8/1978 | Kamiya | 70/347 |
| 4,287,735 | A | * | 9/1981 | Brunken et al. | 70/395 |
| 4,292,823 | A | * | 10/1981 | Reinhard et al. | 70/492 |
| 4,440,008 | A | * | 4/1984 | Uher | 70/492 |
| 4,440,010 | A | * | 4/1984 | Guiraud | 70/409 |
| 4,498,327 | A | | 2/1985 | Preddey et al. | |
| 4,608,842 | A | * | 9/1986 | Tietz | 70/358 |
| 4,672,827 | A | * | 6/1987 | Craig | 70/367 |
| 4,926,670 | A | * | 5/1990 | Deforrest, Sr. | 70/374 |
| 5,209,088 | A | * | 5/1993 | Vaks | 70/384 |
| 5,826,451 | A | | 10/1998 | Cook | |
| 6,257,154 | B1 | * | 7/2001 | Kasper | 109/73 |
| 6,295,850 | B1 | * | 10/2001 | Anderson | 70/492 |
| 7,225,651 | B2 | * | 6/2007 | Edwards | E05B 9/086 70/369 |
| 7,634,930 | B2 | * | 12/2009 | Boesel et al. | 70/383 |
| 7,823,427 | B2 | * | 11/2010 | Katagiri | 70/379 R |
| 2005/0061042 | A1 | | 3/2005 | Lin | |
| 2006/0027004 | A1 | | 2/2006 | Eden, Jr. et al. | |
| 2011/0271722 | A1 | * | 11/2011 | Adolfsson | 70/276 |

FOREIGN PATENT DOCUMENTS

| | | | |
|---|---|---|---|
| DE | 20311099 | U1 | 10/2003 |
| EP | 0879927 | A1 | 11/1998 |
| EP | 1752601 | A2 | 2/2007 |
| FR | 2673973 | | 9/1992 |
| GB | 2 288 427 | A | 10/1995 |
| JP | H07-331934 | A | 12/1995 |
| JP | 08-093283 | A | 4/1996 |
| JP | 2816019 | B2 | 8/1998 |
| JP | 2002-054327 | A | 2/2002 |
| NL | 8104640 | A | 5/1983 |
| SE | 533347 | C2 | 7/2010 |
| WO | WO 2005/008001 | A2 | 1/2005 |
| WO | 2007/044457 | A2 | 4/2007 |

OTHER PUBLICATIONS

International Search Report (PCT/ISA/210) dated Apr. 18, 2010, by Swedish Patent Office as the International Searching Authority for International Application No. PCT/SE2010/050047.
International Search Report (PCT/ISA/210) dated Oct. 27, 2011, in International Application No. PCT/SE2011/050951.
Written Opinion of the International Searching Authority dated Oct. 27, 2011 in International Application No. PCT/SE2011/050951.
Office Action dated Oct. 2, 2012 in Canadian Application No. 2749466.
Australian Office Action dated Sep. 25, 2014 issued by the Australian Government IP Australia in corresponding Australian Patent Application No. 2010207043 (6 pgs).
European Search Report dated Feb. 15, 2015, by the European Patent Office Office, in corresponding European Patent Application No. 10733699.2. (6 pages).
The extended European Search Report dated Mar. 23, 2015, by the European Patent Office in corresponding European Patent Application No. 14197710.8-1503. (6 pages).
Mexican Office Action dated Jul. 17, 2015, by the Mexican Patent Office in corresponding Mexican Patent Application No. MX/a2011/007658. (4 pages).

* cited by examiner

A

B

C

A 1932

A

B 01932
11932
21932
31932
41932
51932
61932
71932
81932
91932
A1932
B1932
C1932
D1932
E1932
F1932

LOCK AND BINARY KEY THEREFOR

TECHNICAL FIELD

The invention relates to an arrangement for a lock as well as a key.

BACKGROUND ART

Locks are known, for example, from U.S. Pat. No. 3,789,638 and U.S. Pat. No. 5,826,451. They comprise a plurality of rotor elements, which can be actuated by a key and which depending on their setting either prevent or enable unlocking.

Mechanical locks are usually based on technology involving a fixed design or configuration, which can only be changed by a locksmith or a professional. This configuration or design is either permanent or factory-made and causes a number of problems for the manufacturer as well as for the user.

A further drawback associated with these prior-art locks is that in the event that the key is lost or that it is desirable to install another lock, in addition to an existing lock, for the same key, a professional (locksmith) has to be called in despite the fact that the locks can be converted or rebuilt to some degree. This is unpractical and involves relatively high costs whether the professional that is called in converts an existing or new lock to fit a certain key or installs one or more new locks.

OBJECT OF THE INVENTION

It is therefore an object of the present invention to provide a lock which owing to a convenient design thereof is more easily convertible or adjustable than previously known locks. A further object is to provide an improved key as compared with prior art.

SUMMARY OF THE INVENTION

The above objects can be achieved by means of an arrangement for a lock and by means of a key according to the embodiments discussed herein. A lock-key combination comprising a lock and a key also is disclosed.

The invention makes it possible to design an inexpensive, environmentally acceptable and resource-saving lock for use both as a separate lock and as a lock included in large lock systems, where all the handling can be taken care of by the customer without the need for any third party assistance. The invention provides for a readjustable lock, for which the customer, knowing the code of the key, is able to easily and rapidly manufacture his or her own key or keys without the assistance of a locksmith or a manufacturer. This also allows lock systems to be handled by a layman using remote control equipment and unsophisticated software.

Further advantages of the invention will be described below.

Traditional locks cannot be produced in large series in a rational manner, since such locks, for self-evident reasons, have to be different from each other. The present invention provides for a unitary lock, so that all locks can be manufactured using the same basic components.

Rational assembly of traditional locks is not possible. In addition to the problem of manufacturing, traditionally designed locks also involve assembly problems and the costs related therewith. The present invention presents a solution to this problem by enabling all locks to be manufactured using the same basic components. This means that rational assembly is possible and even that the assembly operation as such can be carried out by the customer.

Traditional locks must be replaced if the key is lost. If the rightful user of a traditional lock looses all the keys to a lock or if a key of the traditional kind is stolen or it is suspected that a key may have been copied without permission, normally the lock has to be replaced. If a common key for a traditional lock system is lost, all the locks that match the common key have to be replaced. If the common key is also the master key of the system, then all the locks must be replaced. Some pin tumbler locks can be blocked in the event that the key is lost, but the problem remains that the rightful user has to call in a professional to carry out this operation. This takes time, requires professional know-how and costs money. The present invention can solve or at least alleviate this problem by providing a lock that is readjustable. In the case of a separate lock that is not part of a lock system, the lock can be readjusted for example by simply removing the rotor from the lock and rearranging the key-operable locking elements disposed therein in such a manner that a different key code is required to open the lock. In the event that a key of a key system is lost all the locks of the system can be blocked so that the lost key will not fit therein, without having to change the codes of all the other keys of the key system.

Traditional lock systems must be ordered from, manufactured by and delivered by the lock manufacturer. A lock system based on traditional technology must be made to order. When ordering locks and keys normally a special matrix is used which defines the number of locks and keys of the system and which keys that are to fit in the respective locks. The matrix can be worked out at a retailer's shop or a locksmith before it is sent to the lock manufacturer. Alternatively, it is possible to order a lock system directly from the manufacturer. The procedure as such is time-consuming and involves administrative tasks while at the same time the locks and keys must be custom-made. It takes considerable professional skills to design and define locks and key system codes for lock systems which are based on traditional technology. This means that a lock that is part of a lock system is much more expensive than a separate lock that you buy off the shelf at the retailer's shop. Delivery takes weeks, sometimes months. The present invention makes it possible to solve or at least alleviate this problem by enabling the user to buy the desired number of locks for the desired lock system directly off the shelf and to build the lock system without outside assistance. Simple coding terminology makes it easy for the user to decide the lock system codes and the key system codes. As a result, the lock system is significantly cheaper and can be put together more rapidly.

In the prior art, the user cannot on his own make changes to an existing, traditional lock system. The present invention makes it possible to solve or at least alleviate this problem by enabling the user to make the necessary changes himself. Without special tools or specialist knowledge. It is cheap, practical and time-saving.

Nor is the user able to modify a separate traditional lock to have it fit a different key. Certainly, there are locks which can be readjusted a couple of times, but not more. Moreover, these locks are not unitary locks, which means that they will not solve those problems that are solved by such locks. The present invention makes it possible to solve or at least alleviate this problem by enabling simple manual readjustment.

In the prior art, the user is not able to configure a separate lock to have it fit several different keys. In one aspect of the present invention, this is possible by using neutral locking elements in the lock.

In the prior art, keys cannot be manufactured in a rational manner. Because the locks are different, the keys too have to be different. According to one aspect of the present invention, there is provided unitary keys which may initially be uncoded and which remain uncoded until they are coded by the user. This means that the keys can be manufactured to be identical and therefore manufactured in a rational manner.

In the prior art, for an authorised user to gain access to a room for which the user has no key, a new key has to be ordered. According to one aspect of the invention, this problem can be solved by virtue of the fact that knowing the key code allows a new key to be manufactured from an uncoded key.

In the prior art, if the user wants a new key or an extra key, it is not possible to produce this key instantly. First, the user must find a key manufacturer or alternatively send for the key from the lock manufacturer. Furthermore, one of the original keys will be needed. The invention makes it possible to use uncoded keys, which can sometimes be obtained for example in convenience stores. The invention also makes it possible to borrow a key from someone else who has the same type of lock and then to rebuild the key according to the user's own code so that it will open the door. Alternatively, an uncoded key may be kept at hand in a suitable location.

In the prior art, if the locks and keys are different, some form of administrative measure is required according to prior art to match the right key with the right lock. The cost for this is added to the cost of production. The invention makes it possible to solve this problem through the use of uncoded unitary keys, which are assembled into any optional combination by the customer.

In the prior art, a key without a lock is worthless and cannot be reused. The invention provides for uncoded unitary keys which can be assembled into any optional combination by the customer.

In the prior art, a lock without a key is worthless. It cannot be dismounted or reused either in its entirety or in parts. The invention enables readjustment of the lock to have it fit an existing or new key.

All of the above problems might also be relevant for traditional padlocks.

In the event of rescue operations, where personnel who normally do not have access to the premises need to gain entry at short notice in order to save lives and property, the limits of traditional technology constitute a major problem. The present invention makes it possible, having knowledge of the code for the lock, to rapidly enter an apartment, for example in the event of fire, by building a key or by giving the rescue services the means to change the mechanical code of the lock, using remote control, either via a fixed connection or via a wireless connection, such as a mobile phone, into the code used by the rescue services, the ambulance services or the police or, alternatively, by resetting the lock.

Traditionally, it is the manufacturer or the locksmith who has the knowledge and resources needed to manipulate locks, open locks and supply keys and service. Moreover, the manufacturer has copies of their customers' lock and key codes, if the customer has ordered a lock system from the manufacturer concerned. This may cause privacy concerns, which is a problem that can be effectively eliminated by the invention.

The environmental costs associated with the manufacturing process, the travelling costs of the locksmith and the costs involved when discarding replaced locks are considerable as far as modern locks and lock systems are concerned. The invention offers a significant reduction of these costs, since large batches of units can be shipped to retailers, the locksmith's travel costs can be eliminated and the scrapping of replaced locks can be restricted to locks that are worn out or damaged only.

BRIEF DESCRIPTION OF THE DRAWINGS

The invention will be described in more detail below with reference to the appended schematic drawings, on which

DESCRIPTION OF PREFERRED EMBODIMENTS

Working Example 1

A lock according to a first exemplifying embodiment of the invention will be described below with reference to FIGS. 1-3.

Figure 1:
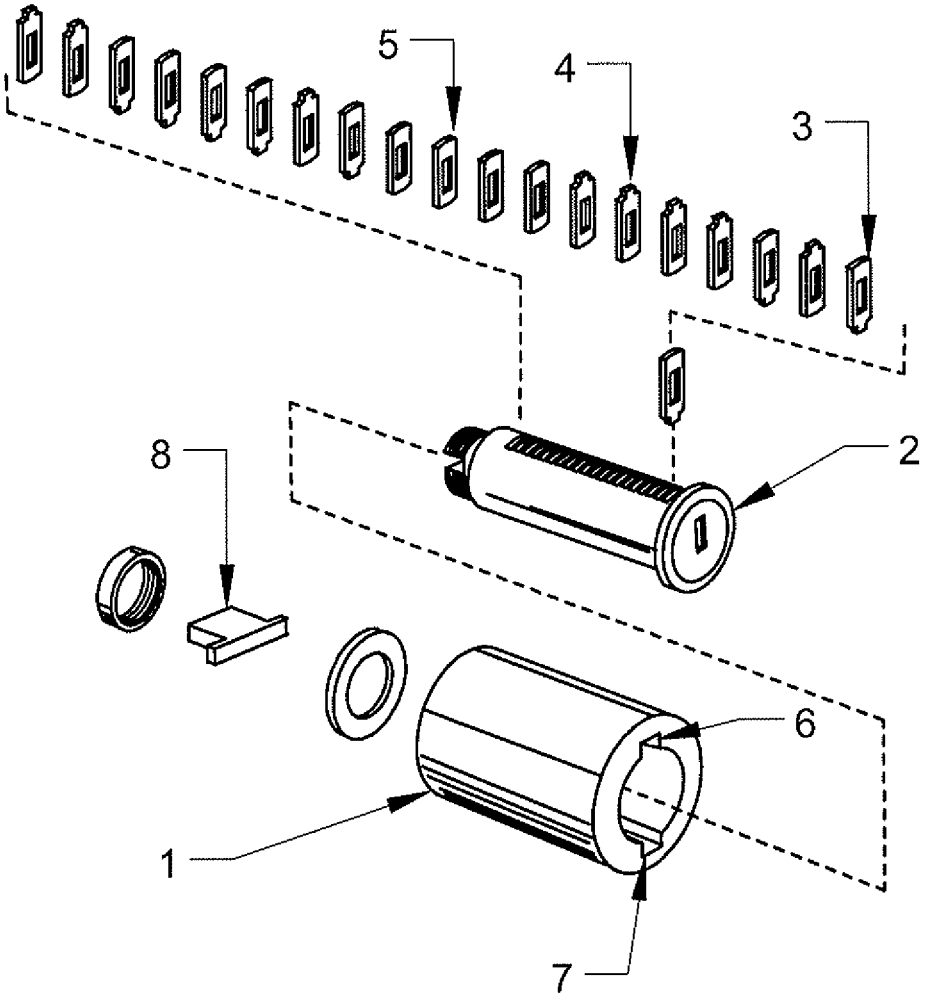
FIGS. 1-3 show a first embodiment of the invention.

FIG. 1 shows a stator 1, in which a rotor 2 is rotatable, provided with an upper channel 6 and a lower channel 7, which extend through the stator 1 along the whole length thereof. The rotor 2 has a plurality of through holes in which elements or pins 3, 4 and 5 are radially movable under the influence of the force of gravity and the actuation by a key. The pins 3 and 4 are identical in design, but can have different functions depending on the orientation of a projection on the pin when positioning said pin in the rotor 2. This projection can be said to form a pointed part of the pin. FIG. 1 shows the pin 3 with its pointed part oriented downwards and the pin 4 with its pointed part oriented upwards. Pin 5 lacks this pointed part and therefore has a neutral function, which will be described in more detail below with reference to FIG. 3. A turning plate 8 is designed such that the rotor 2, when rotated by 90 degrees, can be removed from the stator 1, as the widest portion of the turning plate 8 will then be freely movable in the upper channel 6 and lower channel 7, respectively. This enables the pins 3, 4 and 5 to be rearranged according to a new code, whereupon the rotor 2 is reinserted in the stator 1. The design according to the figure enables the rotor 2 to be removed from the stator 1 when dismounting the turning plate 8, whether the rotor 2 is rotated or not, by first dismounting the turning plate 8.

An alternative design, in which this functionality certainly is lost but which allows a more rational manufacture and assembly, comprises integrating the turning plate into the rotor by forming the turning plate and the rotor in one piece. In this case, neither the turning plate nor a means for attaching it to the rotor need to be manufactured or mounted.

Figure 2:
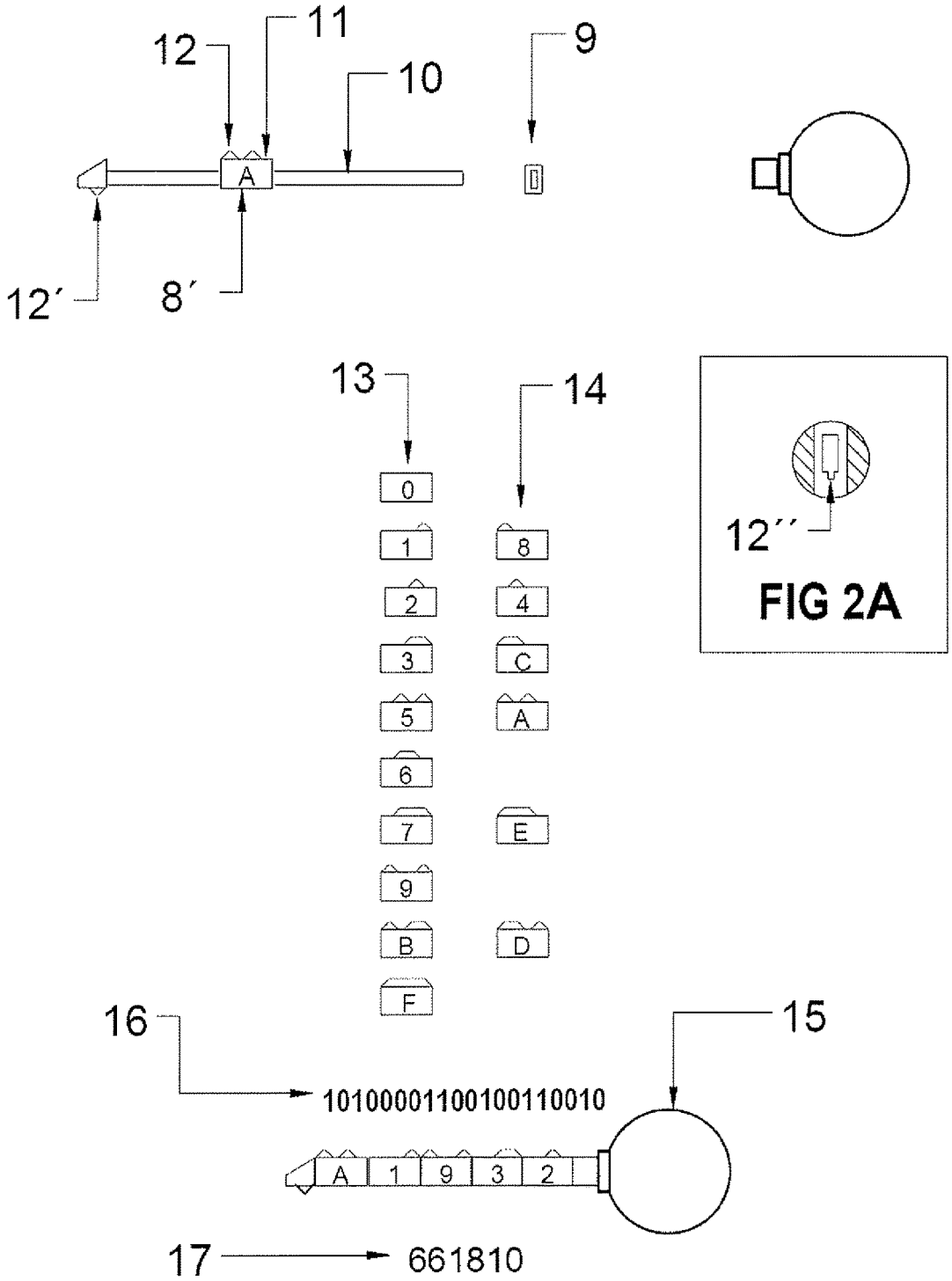

FIG. 2 shows an example of a buildable key 15 made up of different key elements 8', which as viewed from the side 9 have a through hole for enabling mounting thereof on a key shank 10. The number of dimensions in the vertical direction with respect to the profile of the key 15 is limited to two, which means that the whole profile of the key 15, i.e. the identity of the key 15, can be directly translated into a binary code, by each profile height being assigned a binary digit. This facilitates the construction of key profiles, which can then be assembled into a complete, finished key profile. In this way, users are able to select their own key combination. The key 15 shown in FIG. 2 is buildable, but it is also possible to manufacture fixed keys in an inexpensive manner.

In the present case, the small profile height 11 has been assigned the binary digit 0 and the large profile height 12 has been assigned the binary digit 1. According to this embodiment, the key 15 thus has a body along which, in each position corresponding to the binary digit 1, a projection with a height corresponding to the large profile height 12 is provided. A key for a 20-pin lock, as shown in FIG. 1, is represented by a key with one profile height for each pin, i.e. 20 profile heights in the horizontal direction. The number of possible combinations in such a lock is therefore equivalent to all the binary numbers up to a maximum of 20 digits, i.e. 2^20=1048576. The number of profile heights in the horizontal direction on each key element 8' determines how many different key elements that can be manufactured. If the number of profile heights in the horizontal direction is limited to one on each key element, then only two different types of elements, 1 and 0, need to be produced and the key can be made up of 20 different elements.

If, on the other hand, four profile heights are used in the horizontal direction, as in the present example, then 16 different elements 8' are required, since 2^4=16, which also means that, in addition to the binary coding for each element 8', which coding can be translated into a decimal digit, it is also possible to use a hexadecimal marking on the elements, which offers the user even better opportunities for using alternative key codes, i.e. binary, decimal or hexadecimal. In general, a hexadecimal code is easier to memorize, since the hexadecimal system also includes letters. Accordingly, each element can be given a hexadecimal marking, as this numeral system has precisely a base of 16. These 16 key elements with their hexadecimal coding are shown in FIG. 2, columns 13 and 14. It is only the elements in column 13 that need to be manufactured, since they are capable of forming also the elements in column 14 when turned horizontally. The key 15 is built with five such elements, which if marked according to the figure directly form a code that can be translated into a binary 16 as well as a decimal digit 17. (A standard software application such as Calculator in Windows is all that is needed to perform this conversion).

According to FIG. 2, the key 15 can also be provided with a narrower, downwardly oriented rail or lug 12' and the rotor 2 can be provided, according to FIG. 2A, with a corresponding groove 12". By virtue of the lug 12' and the groove 12", which also includes the keyhole, the key 15, when inserted in the lock, will urge pins that in an undesired manner may have become stuck in an upper position downwards. To prevent that the pins of a seizing lock once again get jammed in an upper position during the insertion of the key 15, it is also possible for the key 15 to have such a rail or lug in each position corresponding, in the lock, to a pin that is not to be lifted.

Figure 3:
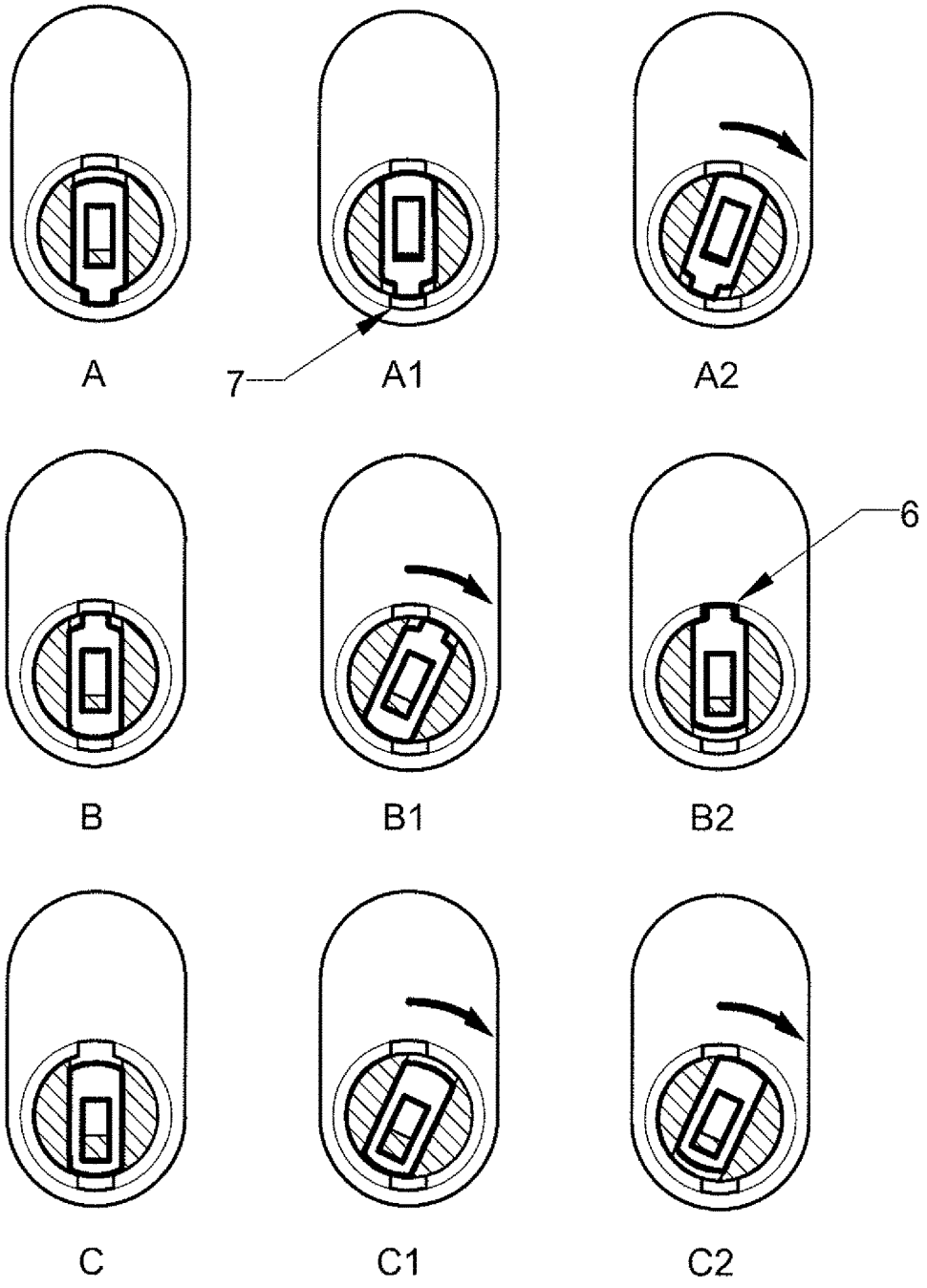

FIG. 3 illustrates the function of the different pins 3, 4, 5. FIG. 3A shows how a pin, with its pointed part oriented downwards, prevents the rotor from being rotated by the fact that the pointed part, due to the force of gravity, is inserted in the lower channel 7 of the stator. FIG. 3A1 shows that the pin, if it is lifted, which occurs if the key has the large profile height, i.e. a binary 1 in a position corresponding to the location of the pin, is lifted out of the channel 7 so that the rotor can be rotated as shown in FIG. 3A2. Consequently, a pin whose pointed part is oriented downwards can be said to represent a binary 1.

If, however, the pin is positioned with its pointed part oriented upwards, as shown in FIG. 3B, it will instead have a blocking function when actuated by a key. This also means that if it is not actuated, i.e. not lifted, it will not prevent the rotor from being rotated. Consequently, a pin whose pointed part is oriented upwards can be said to represent a binary 0, since a binary 0 is required in the corresponding position on the key in order for the rotor to rotate and the lock to open. Should the key on the other hand have a binary 1 in the corresponding position, the pin will be lifted and, because its pointed part is oriented upwards, inserted in the upper channel 6, as shown in FIG. 3B2, thereby preventing rotation of the rotor. Each of the pins 3, 4 is thus readjustably arranged, independently of the others, between a state which upon actuation is blocking and a state which upon the same actuation is releasing.

If a neutral pin, i.e. a pin without a pointed part, is placed in the lock, as shown in FIG. 3C, it does not matter whether the pin is lifted or not, as is illustrated in FIGS. 3C1 and 3C2. In other words, such a pin has a neutral function and, accordingly, it does not matter for this pin whether the key has a binary 1 or 0 in the corresponding position on the key. This means that if x neutral pins are positioned in the rotor, it is possible to have 2^x different keys fit the same lock.

Accordingly, in contrast to traditional technology the lock is not based on the fact that locking elements should be moved a certain distance or rotated by a certain angle, which in both cases can be described as an analogue mechanical solution, but on the idea that the locking elements of the lock should be actuated or not actuated by the key, which can be described rather as a digital mechanical solution. Working Example 1 described above thus provides for a mechanical, manually adjustable unitary lock with a digital mechanical criterion for opening of the lock and a key with a digital mechanical criterion for opening of the lock. The mechanical lock codes of the lock can be readjusted by a user without any special tools. If the lock comprises at least one neutral element, then at least two differently mechanically coded keys will fit the lack.

This means that decimal as well as digital and hexadecimal symbols can be translated into a physical shape of both the key and the mechanical configuration of the lock, while at the same time system lock codes, lock system codes and key system codes can be mathematically defined by means of general algorithms, so that simple software can be developed.

Figure 2B:
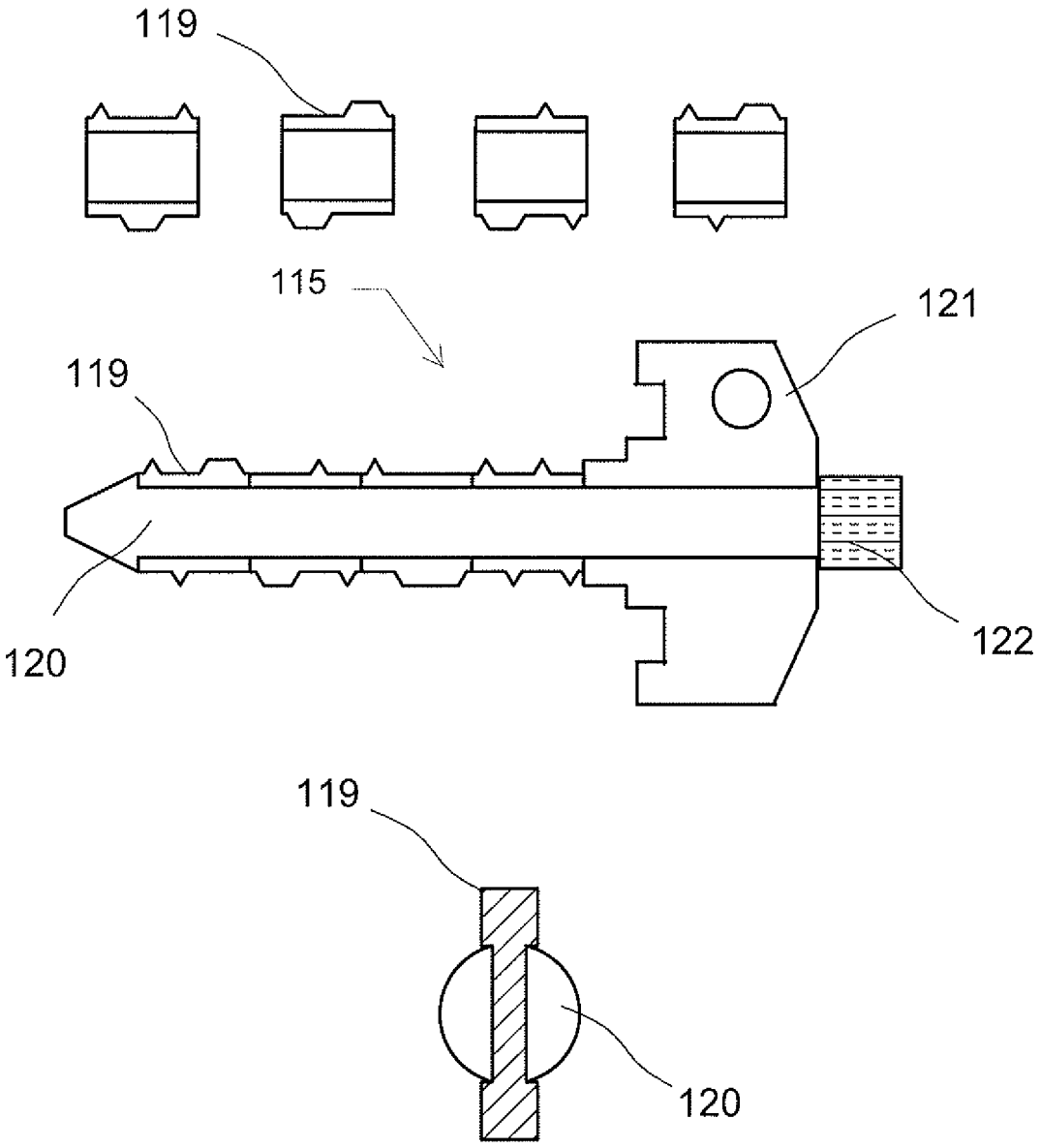

As stated above with reference to FIG. 2, the key 15 can have a downwardly oriented projection or a downwardly oriented lug 12' in each position corresponding, in the lock, to a pin that is not to be lifted. A key 115 with such a two-sided profile is illustrated in FIG. 2B. As has also been mentioned above, this can prevent the pins of a seizing lock from once again getting jammed in an upper position during the insertion of the key 115. A further advantage of a two-sided key profile of this kind is that it enables a lock according to Working Example 1 to be used in locks that are not always vertically oriented or that are dependent on the force of gravity for the pins to be moved downwards. This can be useful, for instance, in the case of padlocks.

As is illustrated in FIG. 2B, the key 115 comprises a plurality of double-profile key elements 119. The key elements 119 are arranged on a shank 120 in a central groove, which extends from one end of the shank 120 towards the opposite end of the shank 120. A cross-section of the shank 120 and a key element 119 are shown at the bottom of FIG. 2B.

The key 115 further comprises a handle, in FIG. 2B in the form of a turning plate 121. The turning plate 121 is arranged in the groove of the shank 120. The turning plate 121 can be arranged on the shank 120 after the key elements 119 have been mounted. The turning plate 121 and the key elements 119 can then be secured by means of a locking washer or nut 122. The rear portion of the shank 120 can for example be threaded to enable the nut 122 to be screwed thereon. The key 115 is thus buildable, but it is also possible to design the key in such a manner that it is not buildable. For instance, the key 115 can be formed in one piece in a moulding or milling operation.

According to a variant, the shank 120 can be designed such that the turning plate 121 can be mounted at either end of the shank 120. This variant makes it possible to move the turning plate 121 to the opposite end of the shank 120 without removing any key elements 119 from the shank 120, thereby reversing the key profile. Reversing for example a key profile corresponding to the binary code 11111111 00000000 will give a key profile corresponding to the binary code 00000000 11111111. Expressed in hexadecimal code, the key profile is changed from FF00 to 00FF. Expressed in decimal form, the key profile is changed from 65280 to 255.

A key profile according to this variant can thus be changed four times, on the one hand by turning the key 115 upside down and on the other by moving the turning plate 121 to the opposite side of the shank 120.

The key design according to FIG. 2B enables the key profile to be built using only six different types of key elements 119. This will be explained in more detail below with reference to FIG. 2C.

Figure 2C:
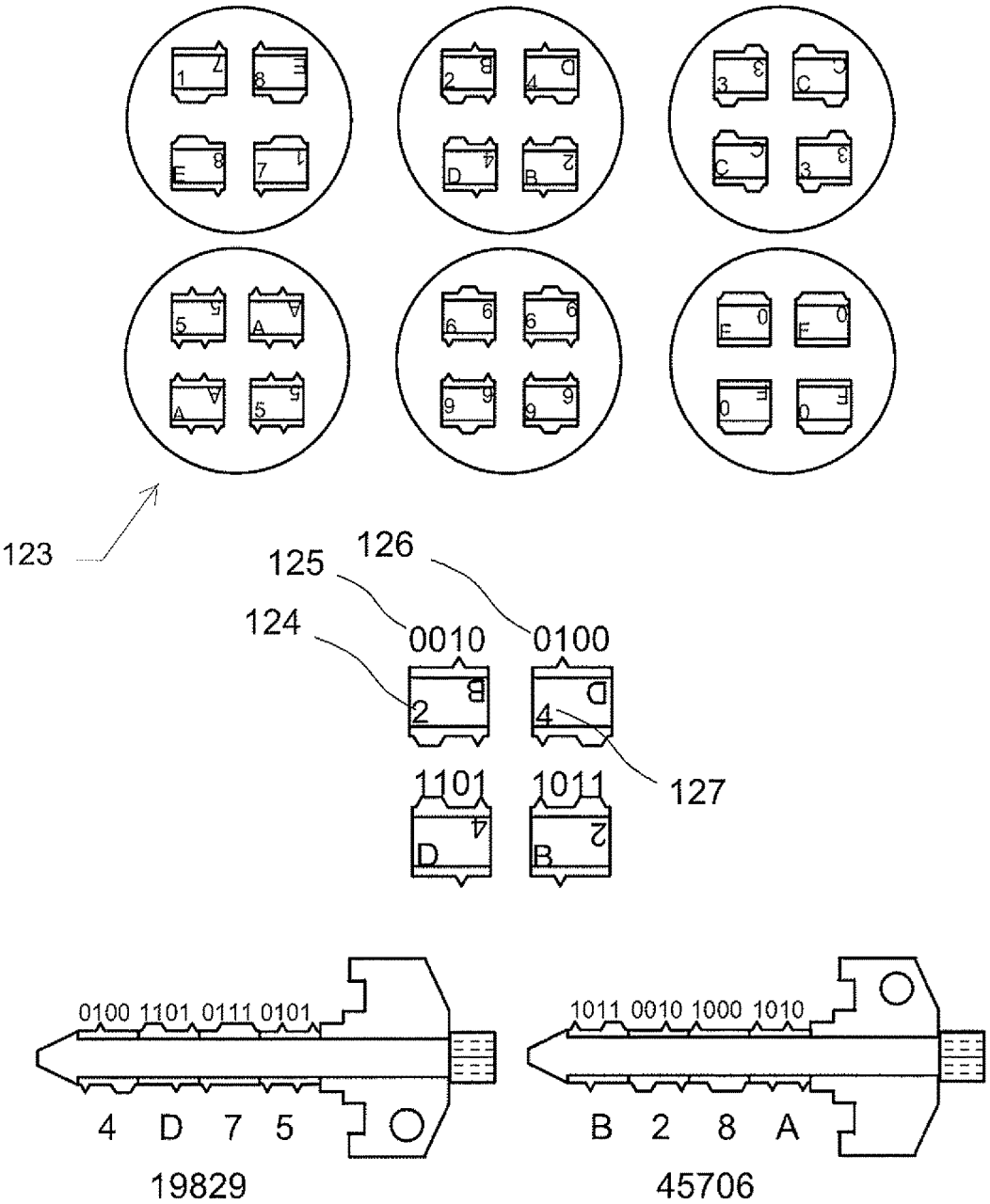

The six different key elements 123 that are needed to form all the 16 occurring 4-bit binary numbers are shown in the upper part of FIG. 2C. The key elements 123 within each circle are identical, but by turning them vertically and horizontally two or four combinations can be obtained. This is illustrated in more detail by the enlarged view in the centre of FIG. 2C. The enlarged view shows one of the key elements in four different orientations. Each element can be provided with a hexadecimal marking 124. This may make it easier for the user to assemble and code the key. The marking 124 indicates the binary profile 125 of the upper side of the element. In the present case 0010 (where 1 represents the large profile height and 0 represents the small profile height). If the same element is turned about its vertical axis (so that the reverse side is shown) the profile is reversed into 0100 (reference numeral 126), which corresponds to the hexadecimal code 4 (reference numeral 127). Starting from these two orientations, the element can also be turned about its horizontal axis, giving the element a new upper profile 1101 and lower profile 1011, respectively.

The lower part of FIG. 2C shows that a single key 115 can be turned in the corresponding manner as the key elements 119 to obtain two combinations, i.e. profiles, in the same key 115. The binary code representing the respective orientation of the key 115 is indicated above the key profiles and the corresponding hexadecimal codes and decimal codes, respectively, are indicated below said profiles. By virtue of the fact that the key can be designed with a cross-section that is symmetrical about the vertical axis both key profiles can be used in rotors having matching symmetrical keyholes.

Figure 2D:
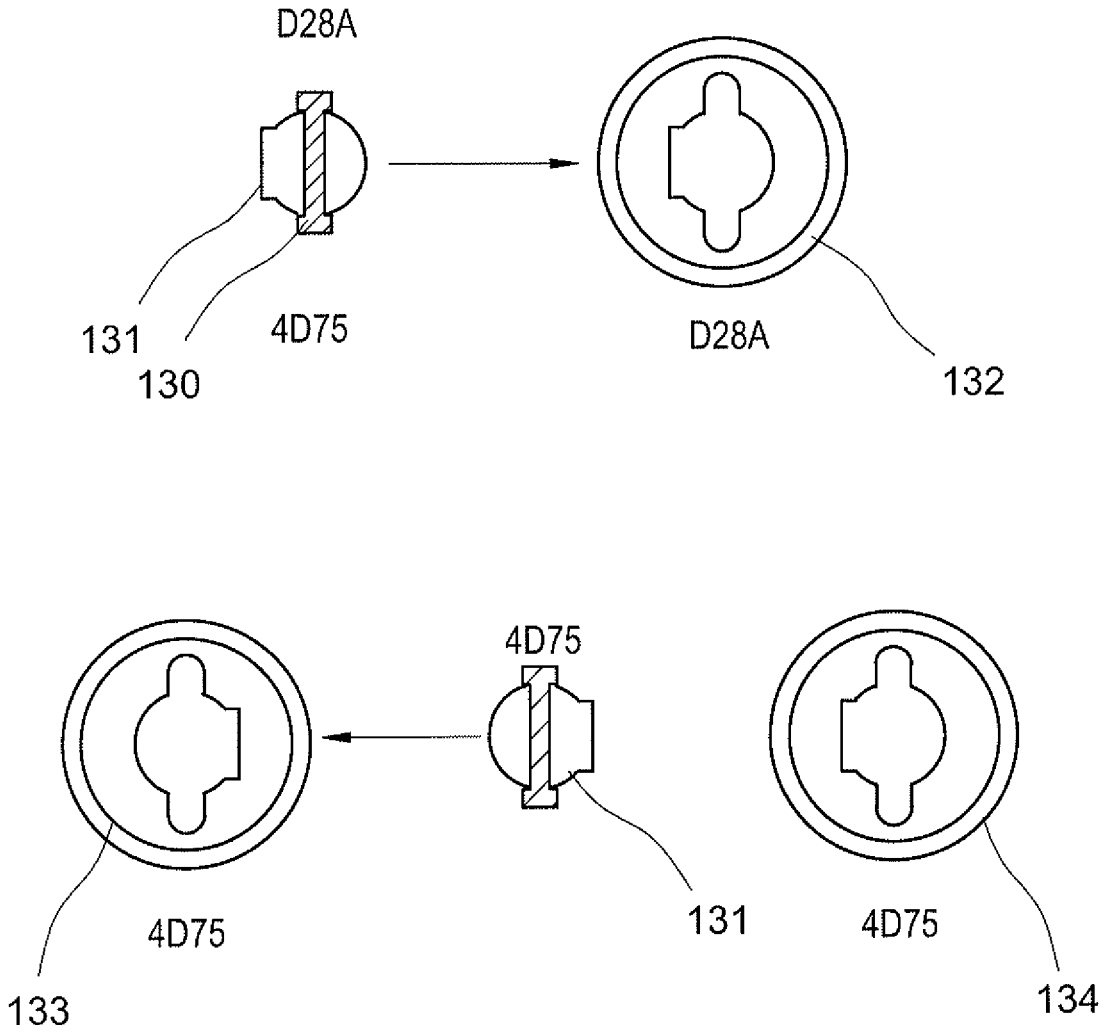

A further variant of a key will now be described below with reference to FIG. 2D. The upper part of FIG. 2D shows a cross-section of the key and the associated shank 131 as well as a rotor 132 with a keyhole whose profile matches that of the shank 131. The key has a two-sided profile similar to that of the key 115 in FIG. 2C. On its upper side the key has a profile 130 which corresponds to the hexadecimal code D28A. Consequently, the key has on its underside a profile 130 which corresponds to the hexadecimal code 4D75. As is evident from the figure, neither the profiles of the key shank 131 nor those of the keyhole are symmetrical about their vertical axes. This means that if the key is turned by 180° about its longitudinal axis it will not fit the keyhole of the rotor 132. As a result, use of the two profiles of the key in two different rotors having the same keyhole profile is prevented. This may be desirable in some cases, as it increases the number of unique lock codes that will be available in a lock system.

Example: if 16 pins are positioned in the rotor 132 such that they form the lock code D28A, the key will fit in the rotor 132. If the rotor 132 with the lock code D28A is turned by 180° about its longitudinal axis, the lock code of this lock will instead be 4D75. And the key will still fit in the rotor. If, however, the pins of two mirrored rotors 133 and 134 are arranged such that they form the same lock code, 4D75, the key will fit only the rotor 133, as is evident from the lower part of FIG. 2D.

Working Example 2

A lock according to a second exemplifying embodiment of the invention will be described below with reference to FIGS. 4-11. This embodiment concerns a remote-controlled binary coded lock system, in which keys of the same type as described in conjunction with the first embodiment are used, but where instead different lock configurations can be achieved by means of a device capable of transmitting digital/analog signals via digital/analog cable lines or wireless channels. The lock in this working example is provided to this end with two electromagnetically controlled components with individually, vertically controlled pins in order that the locking pins should have any one of a blocking, a releasing or a neutral function when actuated by a key.

Figure 4:
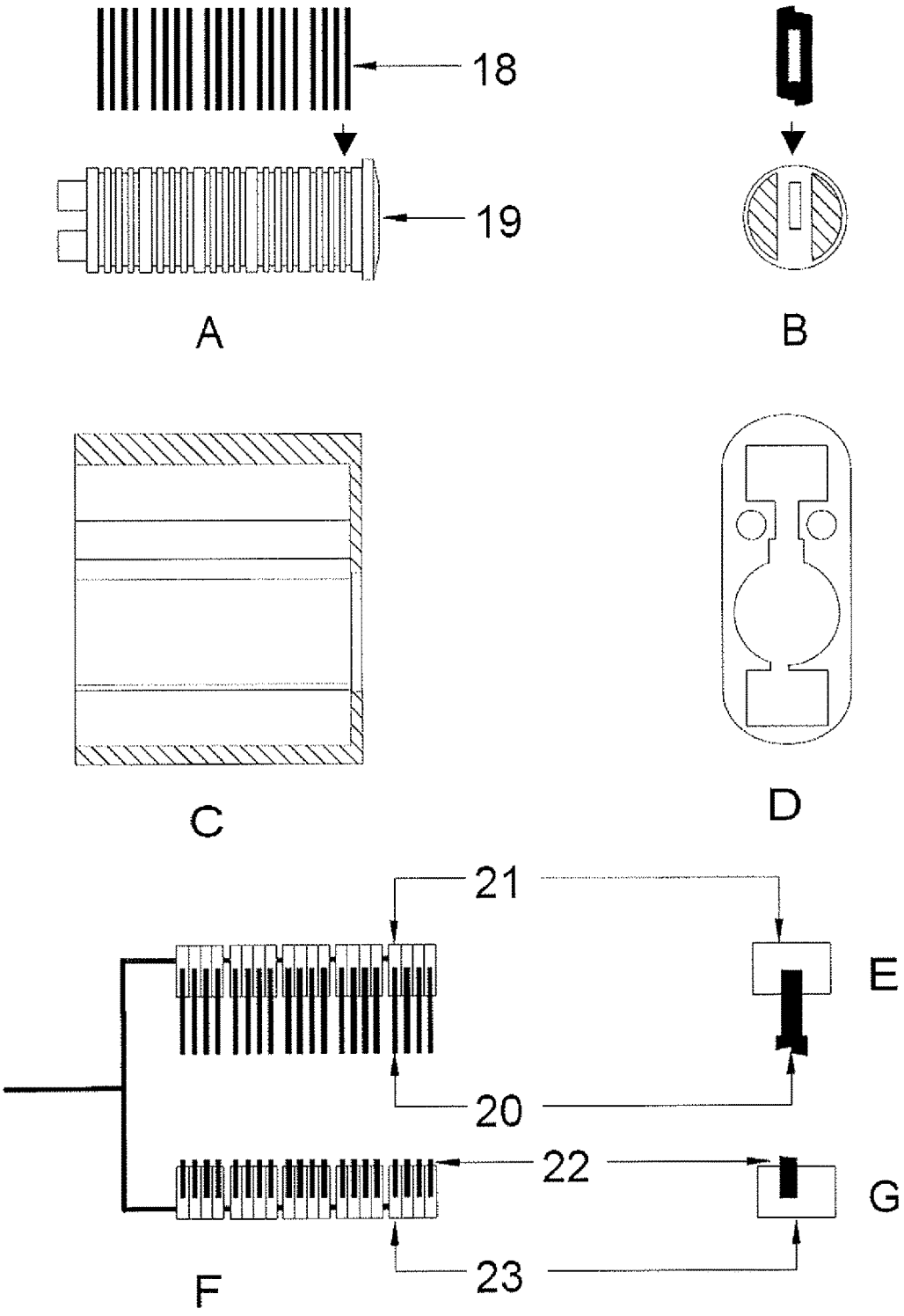
FIGS. 4-8 show a second embodiment of the invention.
Figure 5:
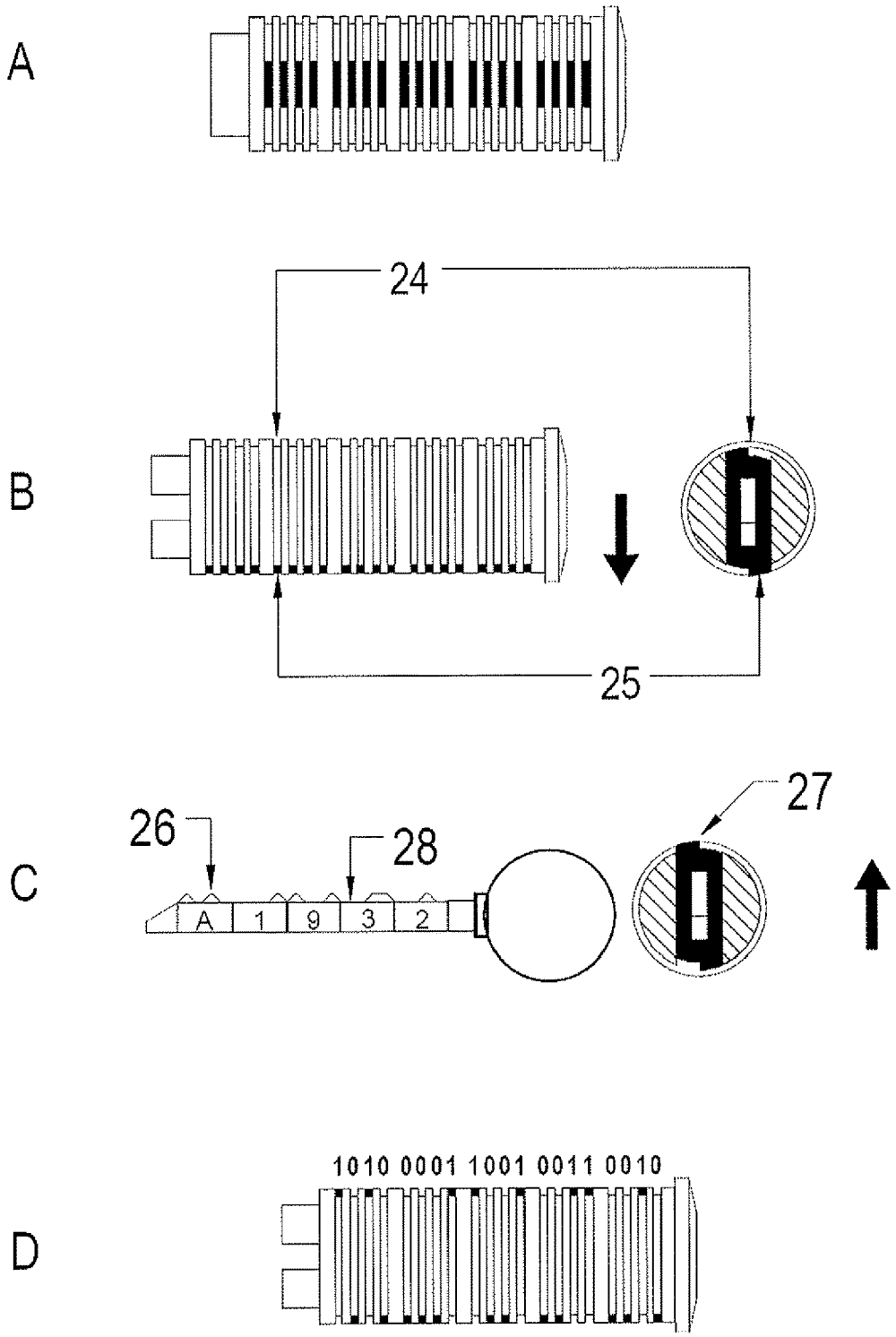

FIG. 4 shows the main parts of the lock. FIG. 4A shows from the side a plurality of elements or pins 18 which are positioned in a rotor 19. FIG. 4B shows the pins 18 and a cross-section of the rotor 19 in a front view. FIG. 4C shows the stator in longitudinal section and FIG. 4D shows it from the side with holes for mounting it in a standard lock case and with enough space for the rotor 19 and upper and lower electromagnets. The upper and lower electromagnets are shown from the side in FIG. 4F. An upper electromagnet is shown in a front view in FIG. 4E and a lower electromagnet is shown in a front view in FIG. 4G together with an upper pin 20, which is controlled by a separate electromagnetic device 21, and a lower pin 22, which is controlled by a separate electromagnetic device 23.

FIG. 5A shows the rotor 19 with pins as seen from above. FIG. 5B shows the rotor 19 from the side with common rotor channels 24, in which both the upper pins 20 and lower pins 22 of the electromagnets as well as the pins 18 of the rotor can be inserted. When the pins 18 are positioned in the rotor 19 they will be urged downwards by the force of gravity, just as in Working Example 1, and will fall out of the rotor 19 unless they are disposed in some kind of stator. When the rotor 19 is arranged in the stator all the pins 18 wilt be located in the position illustrated in FIG. 5B, the lower tip of the pins 18 being positioned in the lower part 25 of the channels. If a key according to FIG. 5C is inserted in such a rotor 19, the pins which according to the previous working example represent a binary 1 on the key 15, i.e. the large profile height 26, will be lifted in the rotor 19, such that the upper portion of these pins 18 are moved into the upper part 27 of the channels, whereas the pins 18 which represent a binary 0 on the key, i.e. the low profile height 28, will remain in the lower part 25 of the channels. The resulting positions of the pins 18 are shown in FIG. 5D, where all the pins that are located in the upper channel can be said to represent a binary 1, whereas pins that are located in the lower channel can be said to represent a binary 0.

Figure 6:
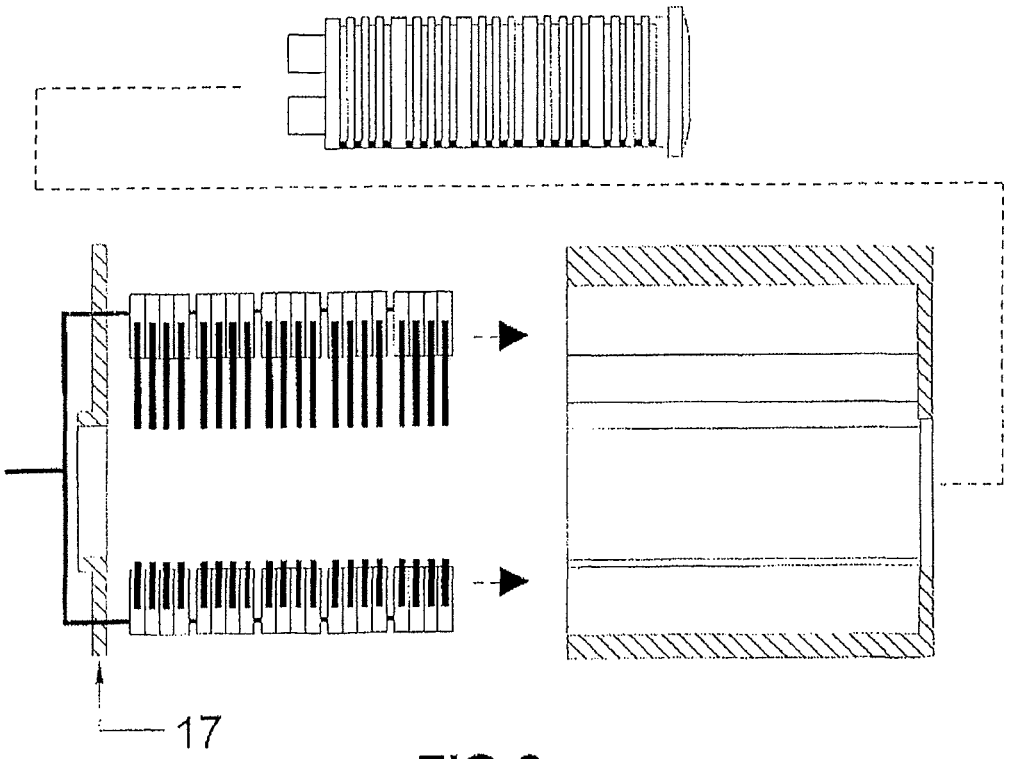
Figure 7A:
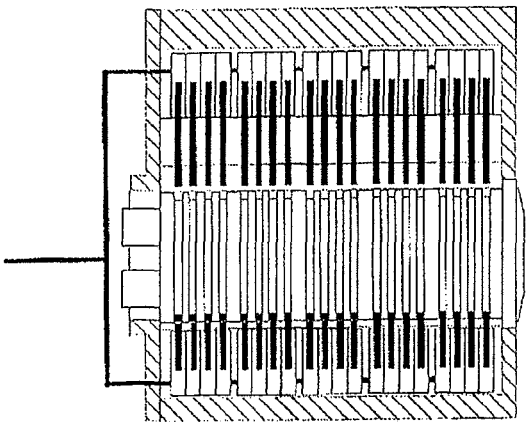
Figure 7B:
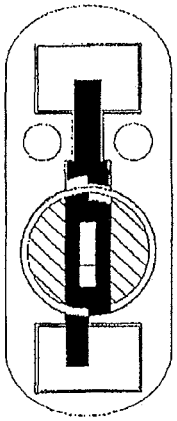
Figure 8:
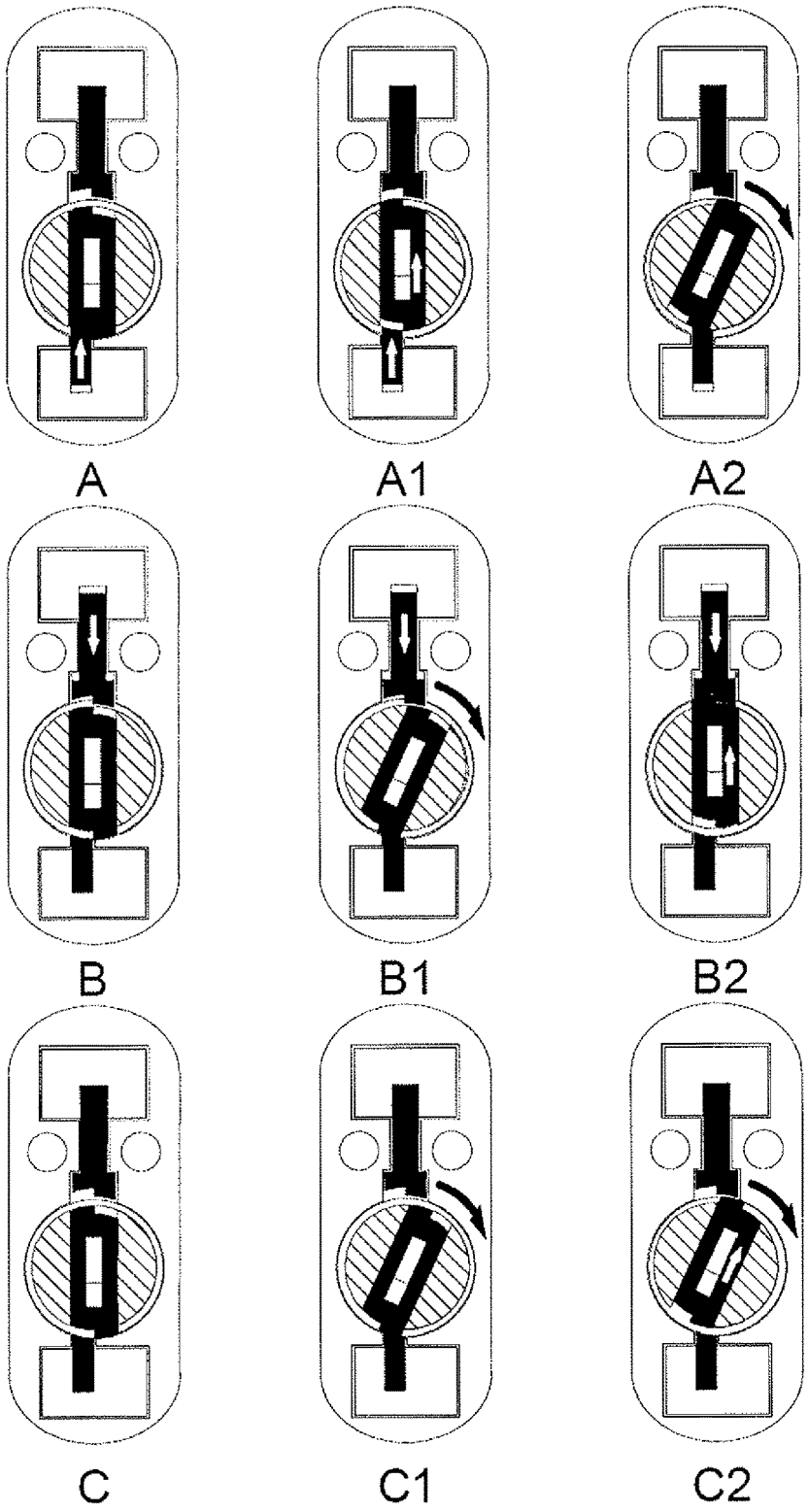
Figure 9:
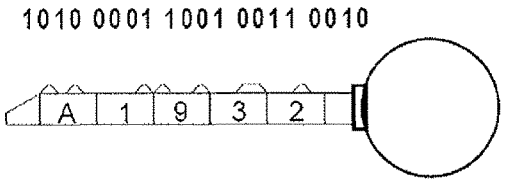
FIGS. 9-14 show a third embodiment of the invention.
Figure 9:
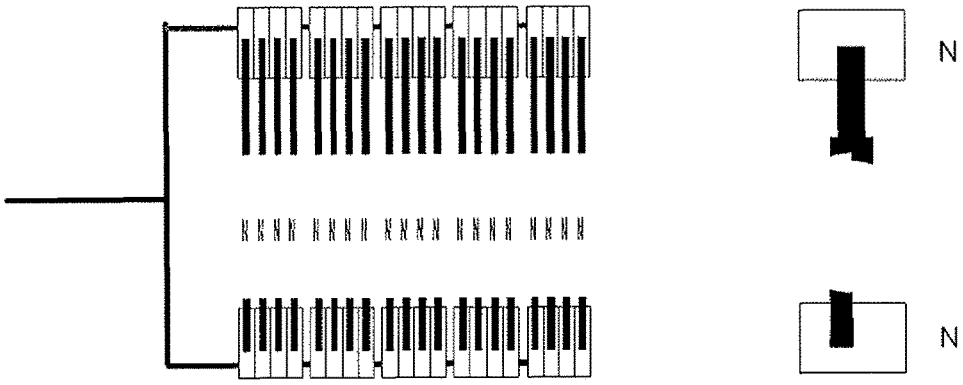
Figure 9:
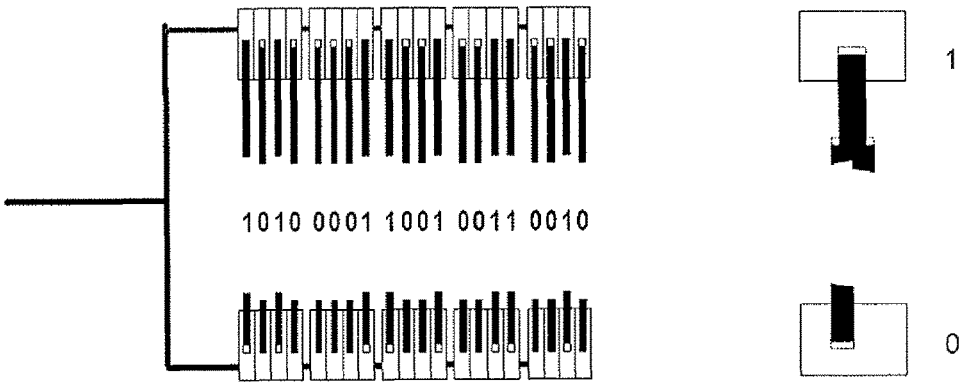
Figure 10:
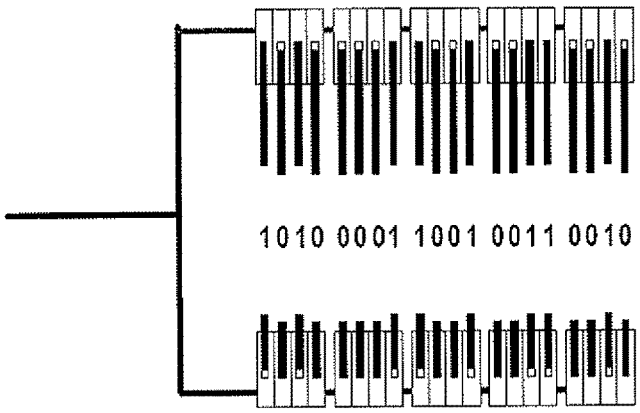
Figure 10:
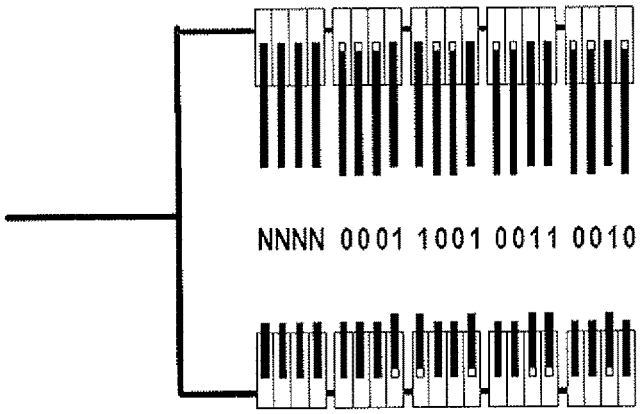

FIG. 6 shows how the mounting of the rotor 19 and the electromagnets with the associated upper and lower pins is carried out. FIG. 7A is a side view in longitudinal section and FIG. 7B is a front view of a section taken through the stator and the rotor 19. Alt the pins 18 in the rotor 19 are here located in the lower part of the common rotor channels and none of the electromagnetically controlled pins are located in any of the common rotor channels.

FIG. 8A shows how the rotor pin is given a releasing function (binary 1) when the electromechanically controlled lower pin 22 is moved upwards into the common rotor channel 24. In this case, the rotor pin 18 must be lifted by the key to enable opening of the lock according to FIGS. 8A1 and 8A2. FIG. 8B shows how the rotor pin 18 is given a blocking function (binary 0) when actuated by the key as the electromechanically controlled upper pin 20 is moved downwards into the common rotor channel 24. FIG. 8B1 shows that the rotor 19 is able to rotate if such a pin is not actuated by the key, whereas FIG. 82B shows that rotation of the rotor is prevented by physical contact with the upper electromagnetically controlled pin 20 in the upper part of the common rotor channel 24.

FIGS. 8C, 8C1 and 8C2 show how a rotor pin 18 is given a neutral function, i.e. neither blocking nor releasing when actuated by the key, due to the fact that none of the electromagnetically controlled pins are moved into the common rotor channel 24. No physical contact can occur with the rotor pin whether it is actuated by the key or not.

FIG. 9A shows a key made up of key elements provided with a hexadecimal marking and the corresponding binary code of the key. FIG. 9B shows the configuration of the electromechanically controlled pins 20, 22 when all pins are neutral "N", i.e. when the lock is not set to match a particular key combination. FIG. 9C shows the position of the upper 20 and lower 22 pins when the lock is configured for the key according to FIG. 9A.

FIG. 10A shows the configuration of the electromechanically controlled pins 20, 22 when configured to match a single key profile only. In this case, none of the positions are neutral, i.e. either an upper 20 or a lower 22 pin has been moved into all the common the rotor channels 24 of the rotor. This means that each pin 18 of the rotor 19 has either a blocking or a releasing function (binary 1 or 0), so that only a unique key will fit in this lock.

FIG. 10B shows how the four front positions of the lock are neutral "N", since neither the upper 20 nor the lower 22 pins have been moved into rotor channels 24 associated therewith. That being so, the profile of the key in these positions is irrelevant when it comes to opening the lock, and keys with a profile corresponding to the key combinations given in the right-hand column in FIG. 10B will all fit in the lock.

Figure 11:
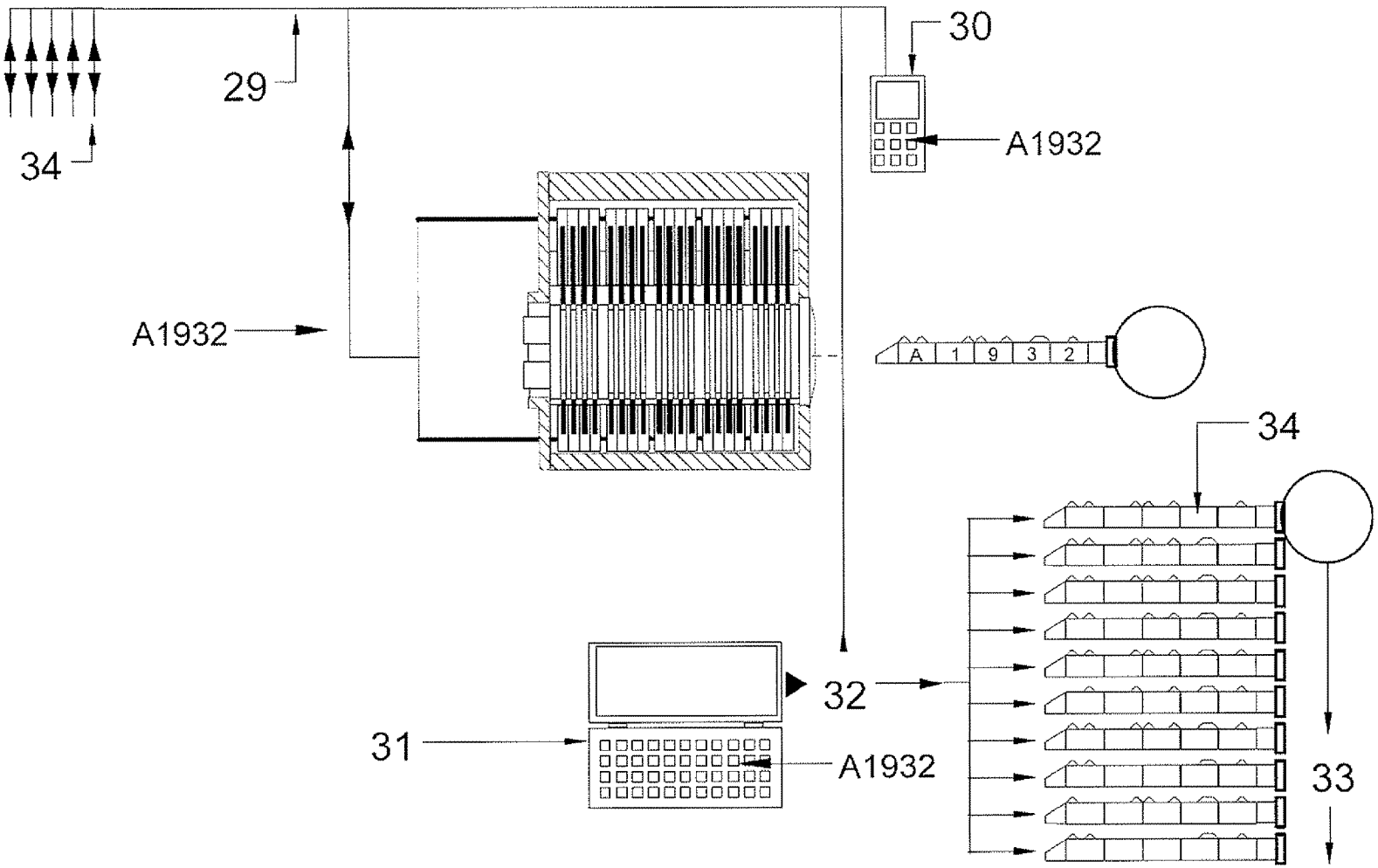

FIG. 11 illustrates schematically how a lock according to Working Example 2 can be controlled over a digital/analog channel 29, for example by means of a mobile phone 30 and/or a personal computer 31. The mobile phone 30 and/or the personal computer 31 can transmit, for instance, a lock code over the channel 29 to a receiver associated with the lock. The receiver can forward the lock code to a control unit, which can set the upper and lower pins according to the transmitted lock code. The mobile phone 30 and/or the personal computer 31 can be provided with unsophisticated software for calculating and determining the data 32 that is required for the manual construction of keys. The mobile phone 30 and/or the personal computer 31 can also provide information concerning inter alia the number of keys 33 and their codes 34 when new lock systems need to be constructed and when existing systems are to be expanded or modified as well as for the purpose of setting individual lock codes 34, in large and small key systems alike. The mobile phone 30 and/or the personal computer 31 can also be used to determine the number of keys and their codes when designing new lock systems.

Working Example 3

A lock according to a third exemplifying embodiment of the invention will be described below with reference to FIGS. 12-14. This working example illustrates how the principle of a binary coded mechanical lock system according to the invention can be applied to a disc tumbler lock by using elements in the form of discs 40 designed so that each disc, just as the pins 3, 4, 5, 18 of the first and second working examples, can have a blocking, releasing or neutral function with respect to a device which, respectively, opens and closes the lock upon actuation by the key, the different functions, i.e. the lock setting, being achieved not by turning the pins as in the first working example described above, but by means of a preset rotation of the discs 40. A key 55 for such a lock is therefore formed with rotating 50 or non-rotating 51 elements in place of the lifting or non-lifting profile heights used in the first and second embodiments.

Figure 12:
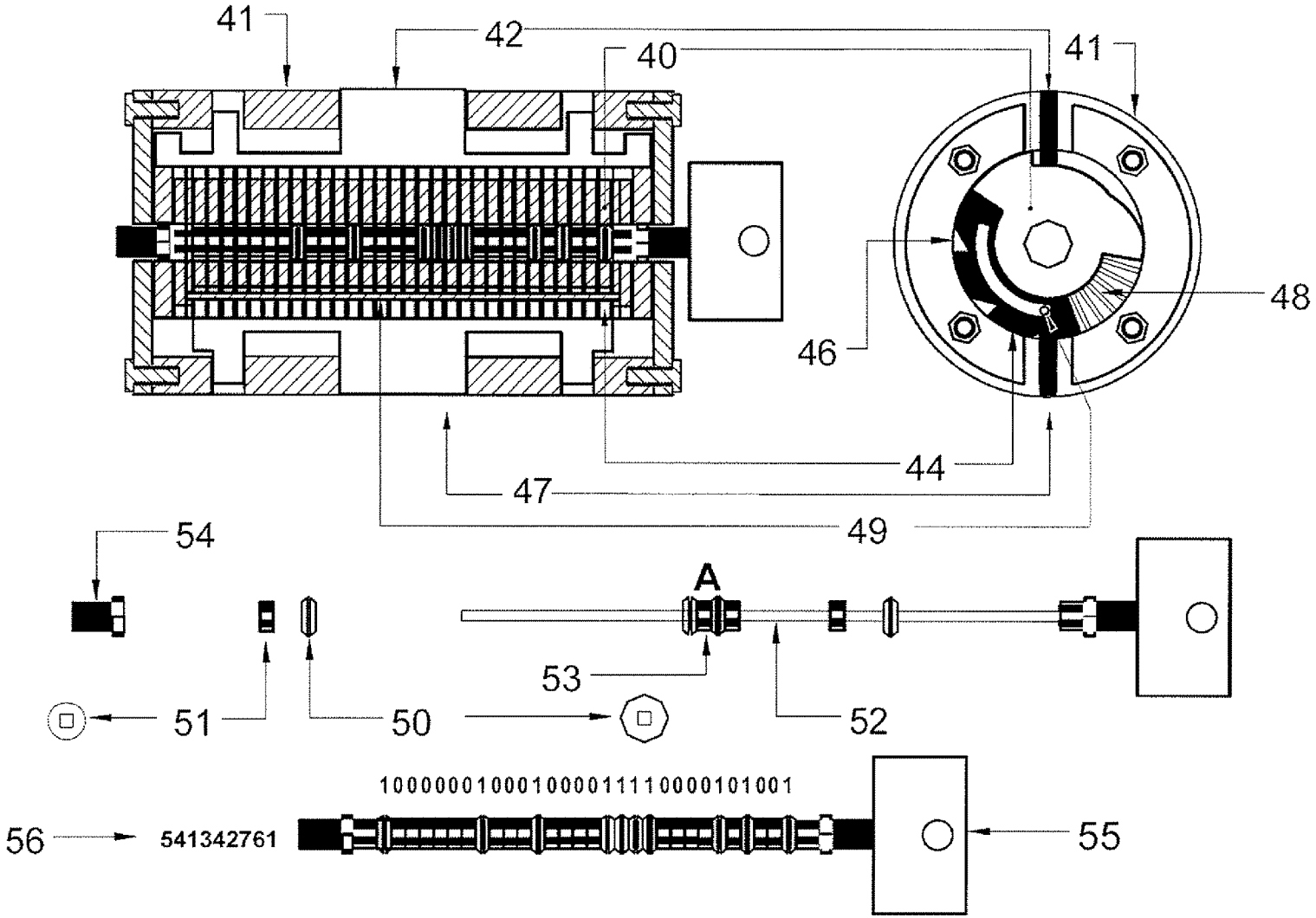

FIG. 12 shows a plurality of discs 40, which are arranged successively, like the pins in Working Example 1, in a rotor 41 positioned in some kind of stator.

The rotor 41 comprises an arm 42, which is movable between an extended position and a retracted position. In the extended position, a portion of the arm 24 protrudes from the circumferential surface of the rotor 41. In the retracted position, the arm 42 has no portion that protrudes from the circumferential surface.

In the extended position of the arm 42, the rotor 41 is prevented from rotating and the lock is thus in a locked state. In the retracted position of the arm 42, the rotor 41 can be rotated. The retracted position is achieved when the discs 40 in the lock are rotated by a key, so that a space for the arm 42 is created in the rotor 41. In the present working example, each disc 40 can be preset to three different positions of rotation, so that when the key 55 is turned either (1) such a space is created or (2) the creation of such a space is prevented or (3) neither the former nor the latter occurs. It will be appreciated that in the case where the correct key for the lock is used the discs 40 will either create a space for the arm 42 or retain such a space when the correct key is turned.

The preset rotation is achieved by means of a device 44 associated with each disc and provided with three notches 46, into which a lower arm 47 can be moved for locking of the device 44. Each disc can be rotated clockwise by means of the key 55 upon opening of the lock and can be rotated back by means of a spring 48 associated with each disc.

The key 55 consists of rotating elements 50 and non-rotating elements 51, which in FIG. 12 are shown from the side and in a front view, the latter view clearly showing that the rotating element 50 has the same shape as the keyhole and therefore engages with the edges of the keyhole causing the disc 40 to rotate upon turning of the key 55, whereas the non-rotating element 51 is circular in shape and has a slightly smaller diameter than the keyhole, such that it is not able rotate the disc 40 upon turning of the key 55.

In this working example, the key 55 is made up of the elements 60, 51, which are slipped onto a key shank 52, the cross-section of which matches the centre hole of the key elements 50, 51, here a quadrangle. The elements 50, 51 are secured to the shank 52 by a locking mechanism 54, which in its simplest form can be threaded onto the shank 52, which is threaded at the top. This enables the key 55 to be constructed from the individual elements 50, 51, each element 50, 51 representing, as in the previous working examples, a binary symbol. In the present example, the rotating element 50 represents the binary digit 1 and the non-rotating element 51 represents the binary digit 0. In order to facilitate the practical handling when assembling the key 55 and when administrating the key codes, the key may in this case as in the previous working examples, be formed of elements consisting of four binary digits, so that the element can be given a hexadecimal marking according to FIG. 12 and the element 53 marked W. An example of a finished key 55 with binary and decimal coding 56 is shown at the bottom of FIG. 12.

The key 55 is thus buildable, but it is also possible to design the key with a fixed key profile. Such a key can for example be formed in one piece in a turning or milling operation.

Figure 13:
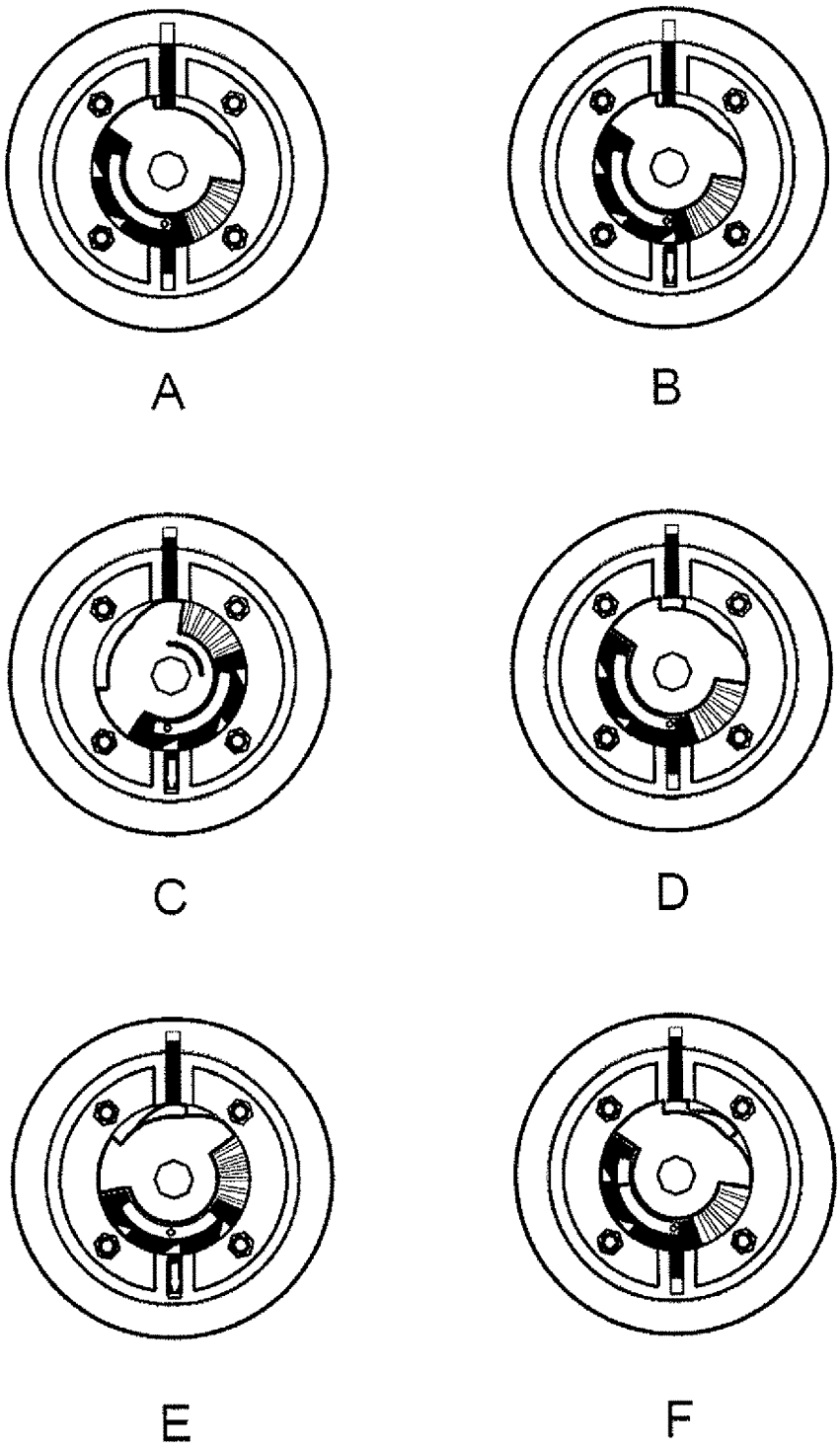
Figure 14:
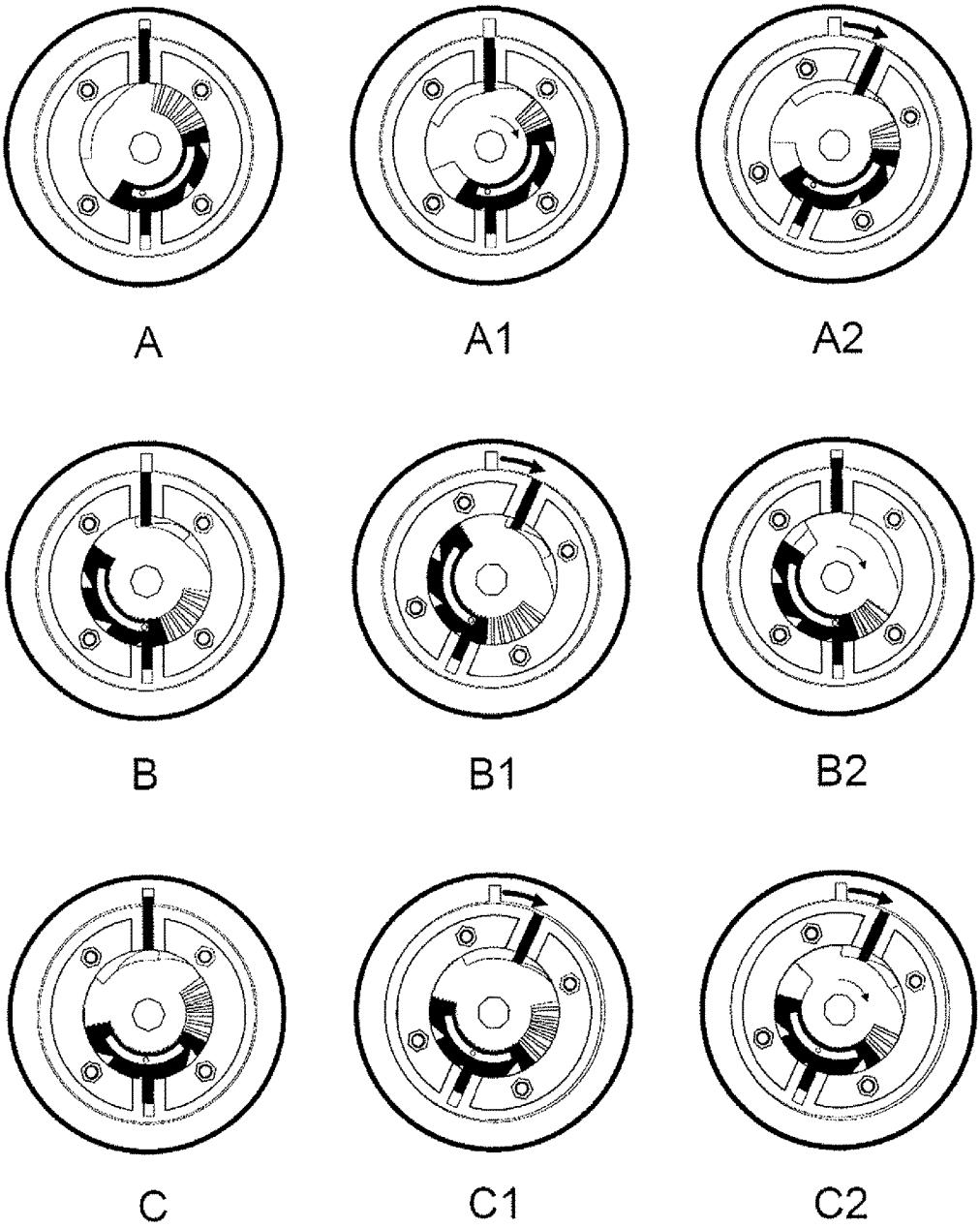

FIGS. 13 and 14 show how the lock setting is carried out in this working example using the same key that is subsequently used to open the lock, which in contrast to Working Example 1 means that the rotor does not have to be removed in order to change the lock code. FIG. 13 shows the different positions of the discs 40 during the setting of the lock and FIG. 14 illustrates the positions of the discs as the actual opening of the lock occurs.

FIG. 13 A shows the position of the discs when the lock is not configured for a certain key or keys. FIG. 138 shows how the lower arm is moved downwards, thereby releasing the device 44 to enable rotation thereof. A finished key is inserted in the lock and turned counter-clockwise. As a result, the discs corresponding to a binary 1 on the key, i.e. rotating elements, are rotated according to FIG. 13C at the same time as the arm is moved upwards, thus preventing the rotor from rotating. The discs corresponding to a binary 0 on the key, i.e. a non-rotating element, are not rotated by the key and remain in the initial position A. This means that all the discs can be said to represent a binary 1 or 0, i.e. they either represent a releasing or a blocking function as in Working Examples 1 and 2. To enable a lock to be configured in such a manner that it can be opened by a several different keys, i.e. be part of a lock system, one or more discs must remain neutral, i.e. neither release nor block the lock when actuated by the key. In Working Example 1, this is achieved by means of at least one neutral pin and in Working Example 2 by the fact that neither the upper nor the lower pins are inserted in the rotor channel. In the present working example, the neutralizing function is achieved by means of the disc, which is rotated by a key designed to this end to a position according to FIG. 13E. A disc that is rotated from this position will neither release nor block the arm and thus has a neutral function. This means that a lock which is configured to match several mutually distinct keys will have discs that are preset to all the three different positions according to FIG. 13F.

FIG. 14A illustrates the functioning of a disc which corresponds to a binary 1, i.e. which has a releasing function. The criterion for this disc is that it must be actuated by the key, i.e. it must be rotated to enable opening of the lock. FIG. 14A1 shows how the arm that prevents the rotor from being rotated is moved downwards by a spring (not shown) when the disc is rotated, thus enabling rotation of the rotor. Accordingly, FIG. 14A1 illustrates, in fact, how the disc is rotated by means of the key so that a space for the arm is created, whereby the arm can assume its retracted position. This means that upon continued turning of the key rotation of the rotor is enabled, as is evident from FIG. 14A2, during which further rotation the position of the disc relative to the rotor is constant.

The discs that have not been rotated by the key in conjunction with the setting of the lock (see above) are shown in FIG. 14B and correspond to a binary 0 on the key. A condition for opening the lock is that these discs are not actuated, i.e. not rotated, by the key when the lock is opened, as is shown in FIG. 14B1. Accordingly, a condition for opening the lock is that the position of these discs relative to the rotor is not changed when the key is being turned. Should the disc be rotated in the manner shown in FIG. 14B2 it will prevent the arm from being moved downwards into the rotor and will thus prevent said rotor from rotating.

On the other hand, a disc which has been set to a neutral position according to FIG. 14C can either remain uninfluenced as shown in FIG. 14C1 or be rotated as shown in FIG. 14C2 without this affecting the opening of the lock.

Further aspects of the invention will be described below.

According to a first additional aspect, there is provided a rotor for a lock comprising a through-extending keyhole. By through-extending is here meant that the keyhole extends axially through the rotor along the whole length thereof. A through-extending keyhole permits a long rotor to be assembled from several rotors. A through-extending keyhole also permits the use of keys of different length in a single rotor. A key which is longer than the rotor can be inserted through the rotor in such a manner that it protrudes from the rear end of the rotor. The through-extending keyhole further permits locks of different rotor lengths to be used in the same lock system. Such a lock system can comprise, for example, locks of traditional length for commonly used entrance and office doors. Short door locks can be equipped, for example, with a lock case or lock housing of a depth such that it enables the key to extend also through said case or housing. Furthermore, the lock system can comprise shorter locks adapted for example for cabinet and desk drawers. Locks of this kind often have no lock case.

Advantageously, a rotor with a through-extending keyhole can be combined with the type of lock technology described above with reference to Working Example 1. However, a rotor with a through-extending keyhole can also be regarded as a particular aspect of the invention and can be used in locks of traditional type, such as a conventional pin tumbler lock.

One working example of this first additional aspect of the invention will now be described with reference to FIG. 15, which shows a rotor 100 with a through-extending keyhole. FIG. 15*a* is a side view of the rotor 100, FIG. 15*b* is a front view of the rotor 100, FIG. 15*c* is a view of the rear end of the rotor 100 and FIG. 15*d* is a view of a portion of the rotor 100 as viewed from the direction D according to FIG. 15*c*. The rotor 100 comprises, like the rotor 2 in Working Example 1, a set of pins adapted to cooperate with a stator, each of the pins being readjustably arranged, independently of the others, between a state which upon actuation by a key is blocking and a state which upon the same actuation by the key is releasing.

The end portion of the rotor 100 comprises four radial projections, which extend radially beyond the circumferential surface of the rotor 100 and form a profile 101. The rotor 100 is further provided with a profile 102 adapted to cooperate with other components of the lock case, such as a latch. The rotor 100 with the profiles 101 and 102 can be formed in one piece by casting or metal injection moulding. The front portion of the rotor 100 is provided with a circumferential flange or rim, which extends radially beyond the circumferential surface of the rotor 100. The rotor 100 can be used in a stator having an axially through-extending hole with an inner profile shape that corresponds to the profile 101. Preferably, the length of the stator is equal to the length of the circumferential surface of the rotor, i.e. the distance between the front flange and the rear radial projections. The rotor 100 can be secured to the stator by inserting it in the stator in such a manner that the projections run in the channels of the stator and subsequently turning it so that the profile 101 of the rotor does not overlap the inner profile of the stator and the pins are able to interact with the stator channels. A stator of this kind thus comprises four radially inner, and axially through-extending, stator channels. The number of projections at the rear end of the rotor 100 can, however, be higher or lower than four. The rotor may for instance have only two projections. Such a rotor can be inserted and mounted in a stator similar to the one in Working Example 1.

The design of the rotor 100, together with the channels of the stator, thus permits the rotor to be mounted in the stator in one piece without having to remove any material from the rotor for the purpose of attaching fastening devices. As a result, a high-strength rotor 100 can be provided despite the fact that the amount of material is reduced because of the through-extending keyhole. In addition, by manufacturing the rotor 100 in one piece the manufacturing and mounting processes are rendered more effective. If the strength requirements are moderate it is also possible to manufacture the rotor 100 from several parts.

Figure 16:
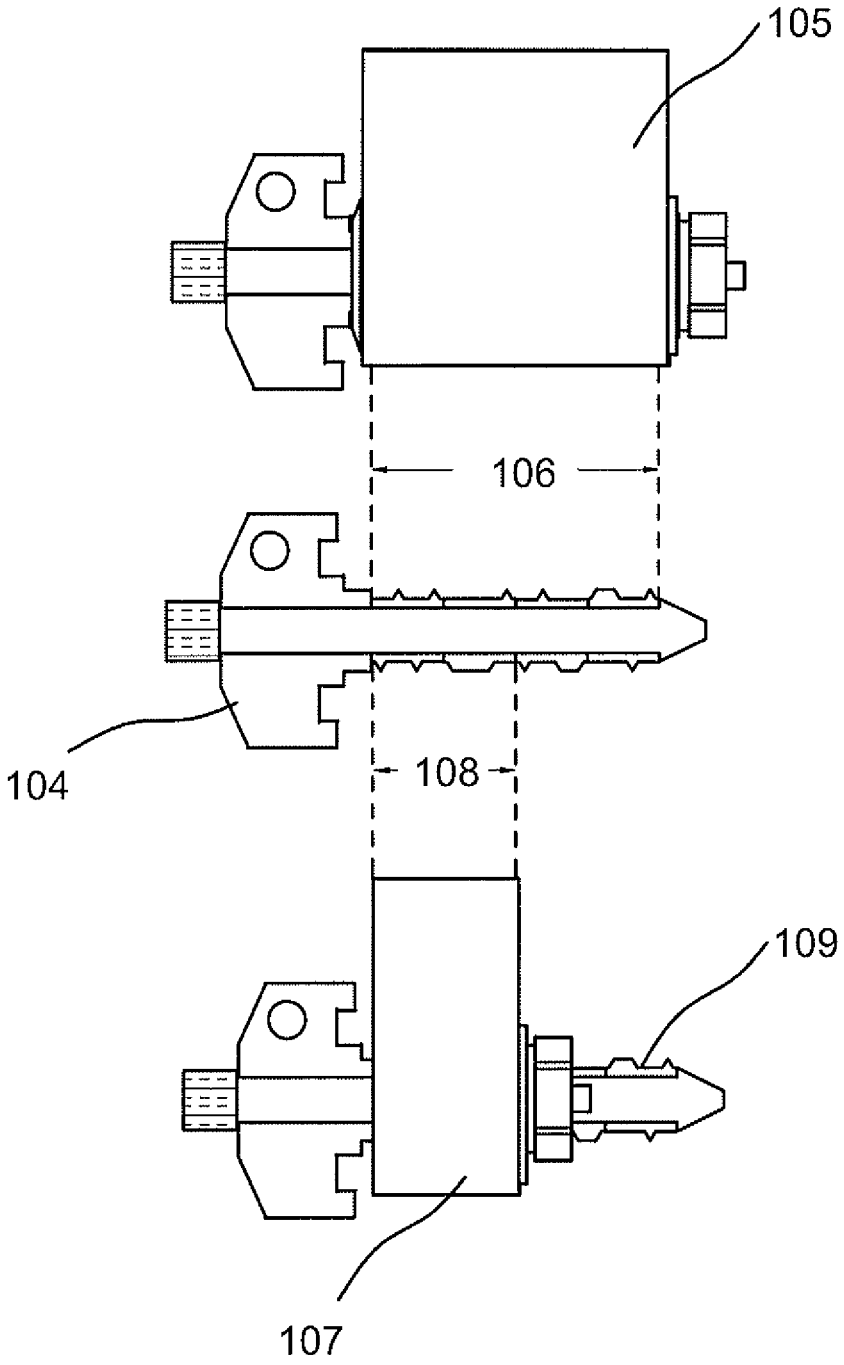

FIG. 16 illustrates a working example of a key 104 which fits both in a lock 105 that spans the whole length 106 of the coded profile of the key and in a shorter lock 107 that spans only part of the length 108 of the coded profile of the key. Thus, a portion 109 of the key will protrude from the rotor of the lock 107. The rotors of the locks 105, 107 have a code that corresponds to the first portion 108 of the coded profile of the key. These rotors are more user-friendly since the key 104, in both cases, can be inserted all the way into the rotor.

A rotor with a through-extending keyhole thus enables the use of keys which are of greater length than the rotor. Moreover, a rotor with a through-extending keyhole can also be used in other applications, which will be described below.

Traditionally, locks are mounted on both sides of a door, not only to enable the door to be locked from both sides, but also because the installation of the lock in the door panel and lock case is made stronger by the fact that the locks on both sides of the door are joined together by means of through bolts extending through the door and the lock case. The sturdy installation afforded by this double mount can also be achieved, where desirable, in a door which gives access to closed spaces, for example store rooms or filing rooms, but which need not be locked from the inside, by providing a double mount in the form of a blind cylinder, i.e. a cylinder that lacks the functions of a lock, on the inside of the door. Traditional lock technology normally requires the lock to be mounted on the front side of the door. A drawback of such a mounting is that a lock on the front side of the door will be an easy target for tampering and manipulation.

Figure 15:
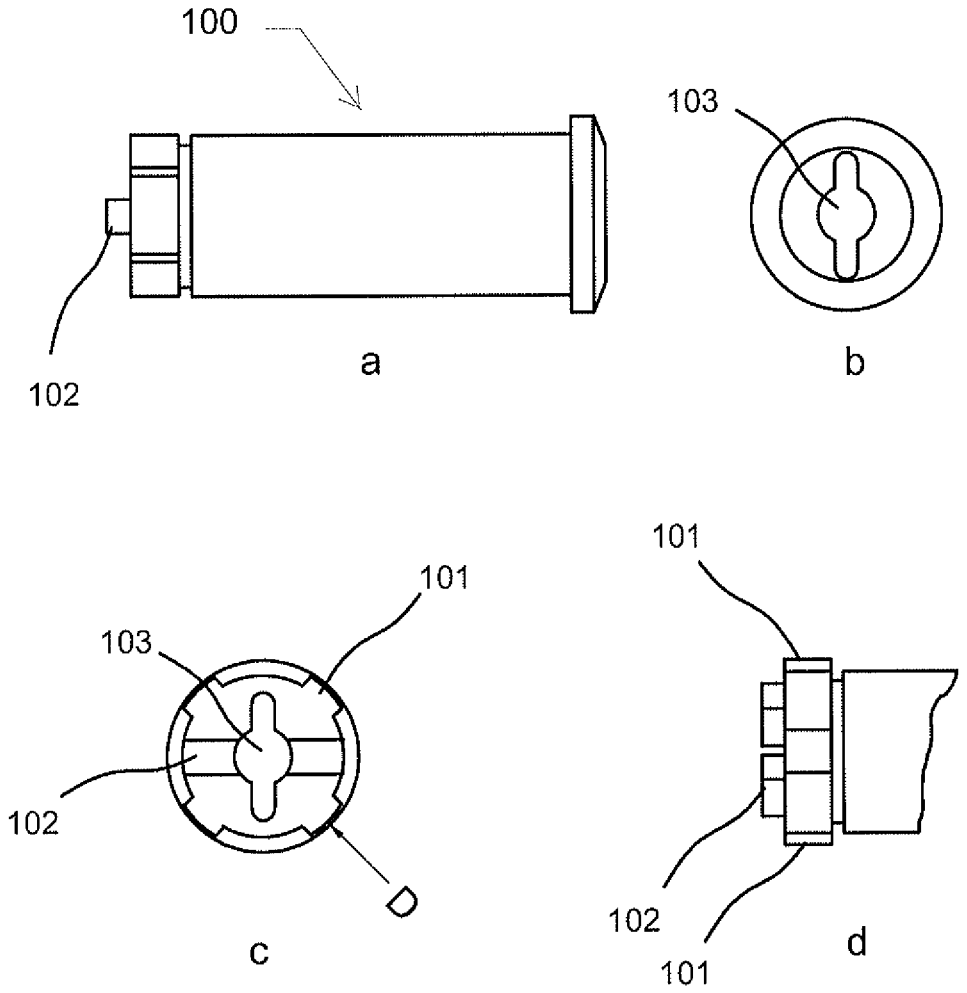
FIGS. 15-16 show an embodiment of a rotor and a key according to one aspect of the invention.
Figure 17:
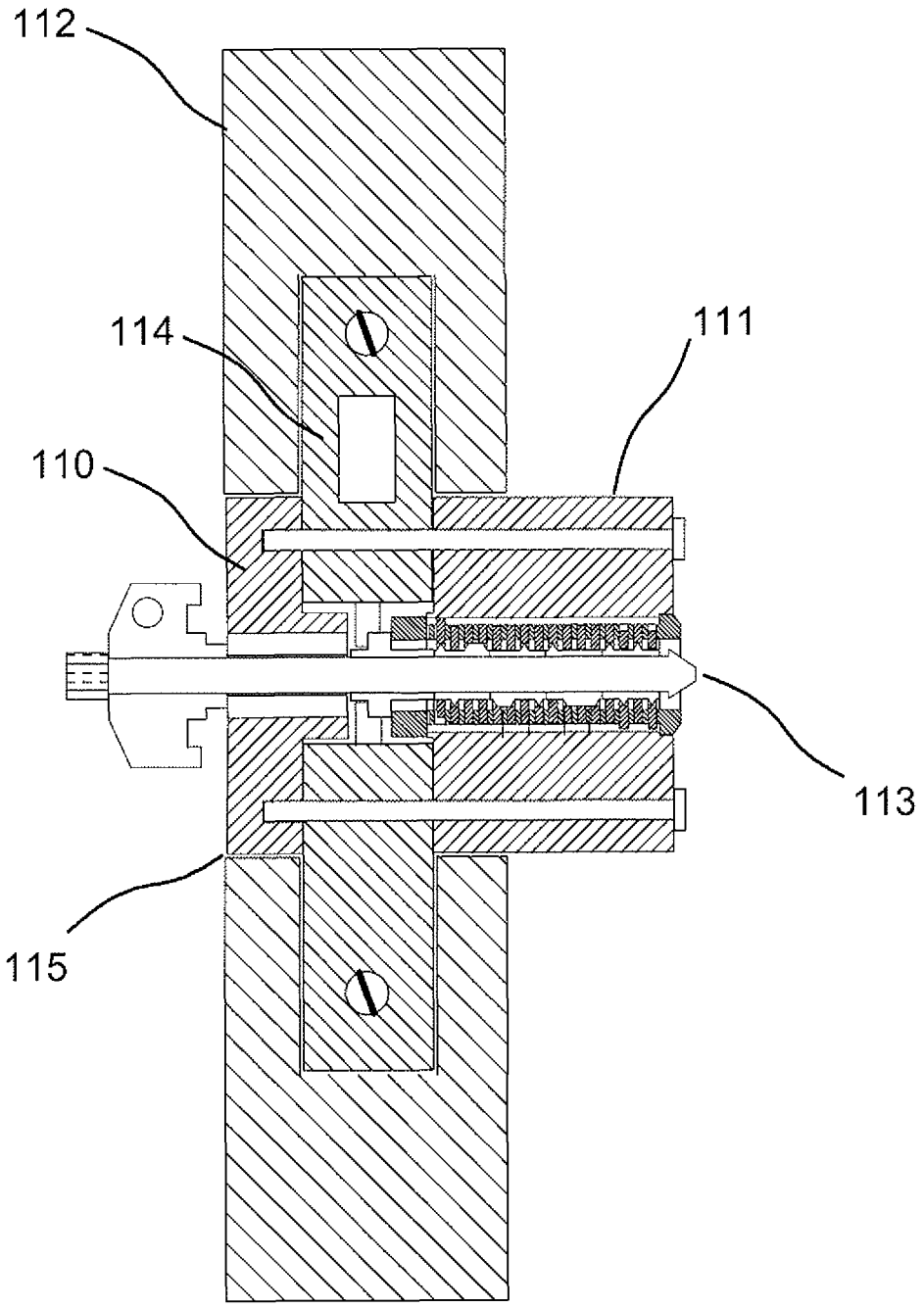
FIGS. 17-18 show an embodiment of a lock and a key according to one aspect of the invention.

A rotor with a design corresponding to the rotor 100 in FIG. 15 enables a lock to be mounted in a protective manner on the inner side of a door. This is illustrated in FIG. 17, which shows a door 112 with a lock 111 arranged on the inside thereof. A blind cylinder 110 is mounted on the front side of the door 112. By virtue of the fact that the rotor has a through-extending keyhole, it is possible to insert a key 113 via the blind cylinder 110 through the lock case 114 and, from behind, into the inner rotor. This means that the blind cylinder 110 can be designed in the best possible way to withstand tampering by a burglar. The cylinder 110 can for example be made short enough not to extend beyond the door, but to be flush with or located inside the outer surface 115 of the door. Furthermore, other manufacturing methods or materials can be considered when designing the cylinder 110. At the same time, tampering and manipulation of the lock 111 becomes more difficult, since one has to force not only the blind cylinder 110 but also the door 112 and the lock case 114 to access the lock 111 itself. A further advantage is that the lock 111 can be made considerably longer without the risk of it being broken away from the lock case as a result of outside tampering. Moreover, a lock provided on the inside of the door is protected against the elements, which can considerably increase its service life.

Figure 18:
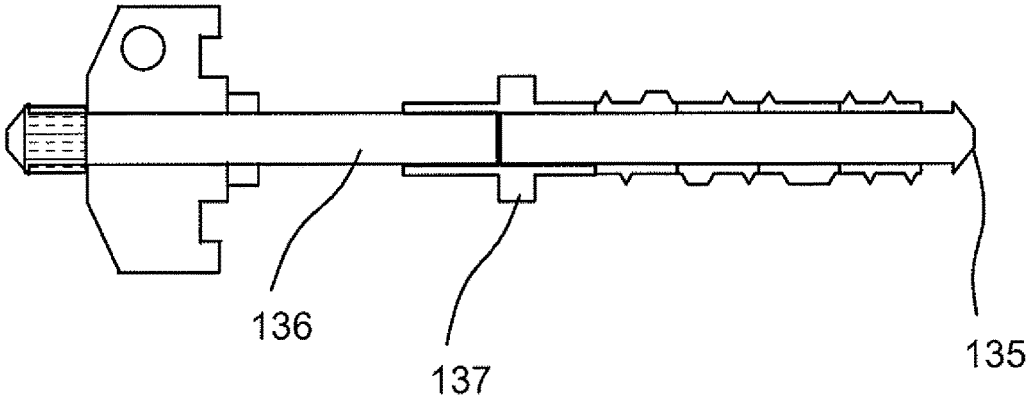

FIG. 18 shows an embodiment of a key designed for use in a lock mounted in a protective manner of the type shown in FIG. 17. The front profiled portion 135 of the key has a binary profile similar to that which has been described for example with reference to FIG. 2B. This front portion 135 is inserted in the lock through the blind cylinder from the outside as shown in FIG. 18 via the lock case and into the rotor from the rear end thereof. The central portion 137 of the key is designed so as to form a stop abutting against the rotor to ensure that the coded front portion 135 of the key is correctly positioned in the axial direction in the rotor. The inner portion 136 of the key is designed such that this portion is able to rotate in the blind cylinder upon turning of the key. The inner portion 136 of the key may for example have a circular profile. Like the key described with reference to FIG. 2B, this key can be built from different elements to enable rekeying or, alternatively, it can be designed with a fixed profile.

Figure 19:
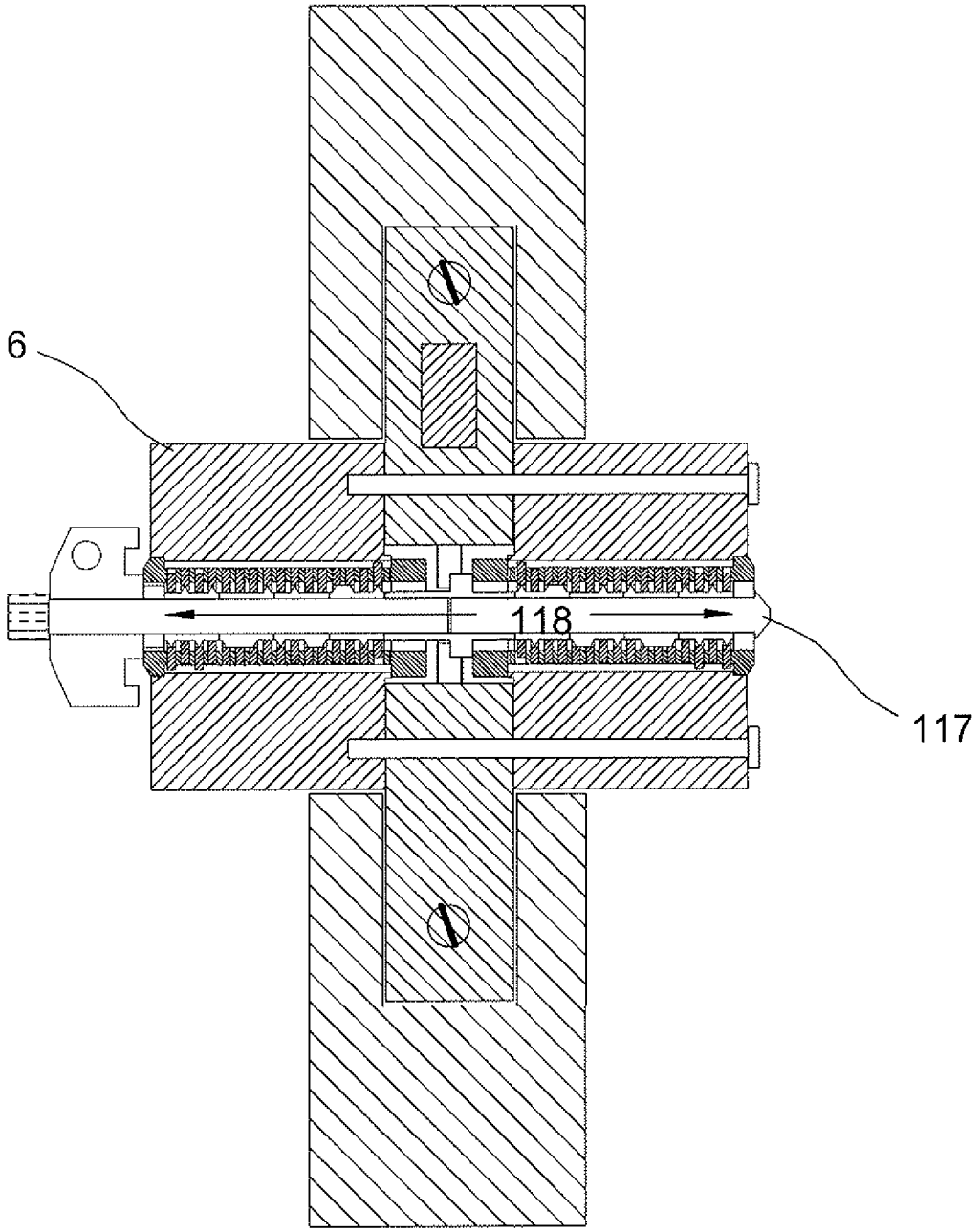
FIGS. 19-20 show an embodiment of a lock and a key according to one aspect of the invention.

A further embodiment of a lock is shown in FIG. 19, where the outer blind cylinder in FIG. 17 has been replaced by a stator-rotor combination 116. The lock thus comprises an outer as well as an inner rotor. Both the outer rotor and the inner rotor are of the type having a through-extending keyhole as described previously. A key which is inserted in the lock from the outside is inserted at the front end of the outer rotor and extends into the inner rotor from the rear end thereof.

Figure 20:
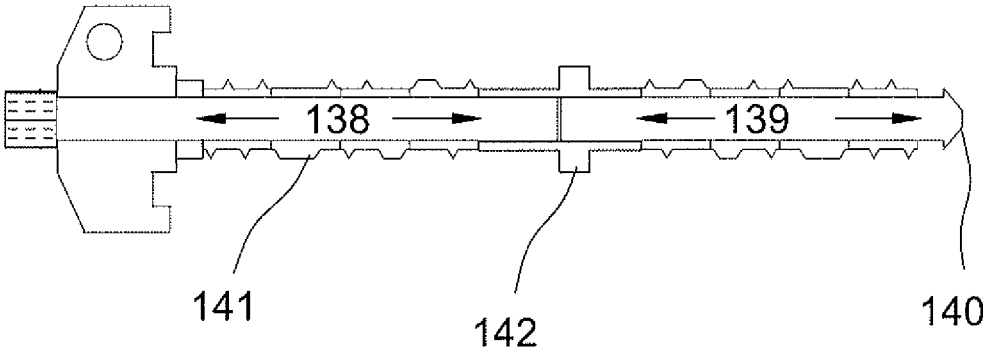

A key adapted for use in such a lock is shown in FIG. 20. The key has a rear profile 138 which fits in the outer rotor, and a front profile 139 which fits in the inner rotor. In order to ensure that the respective key profiles are correctly positioned in the axial direction in the rotors a spacer disc 142 can be arranged between the elements. Since this spacer will be situated in the lock case when the key is inserted in the lock it does not have to be provided with a profile. The length of the spacer can therefore be adapted to different thicknesses of the lock cases and doors. Moreover, this spacer can serve as a stop abutting against the rear end of the inner rotor. The spacer can also be used to join together two key members which each fit in a separate lock, so as to form a key for a two-piece lock. Two separate, double-profiled key members can be joined together in 16 different ways. Like previously described keys, this key can be built from different elements to enable rekeying or, alternatively, it can be designed with a fixed profile.

The lock in FIG. 19 and the key in FIG. 20 thus enable a large number of combinations while offering a high degree of security, since both rotors must be forced for the burglar to gain access to the premises. In such an installation, the number of combinations is equal to the product of the number of combinations for the two locks. By using rotors of standard length more than four billion combinations will be available in a double mount lock.

It is also possible to provide each rotor with a separate lock combination, which means that the lock can be opened from either side, but two different keys will be required for each door depending from which side the door is to be locked or opened.

In the event that a burglar breaks into a room via a passage other than the one where the lock according to FIG. 17 is mounted, it is desirable that the door should not be openable from the inside. From the inside the burglar has access to the bolts which attach the stator in the lock case and might therefore be able to force the lock.

Figure 21:
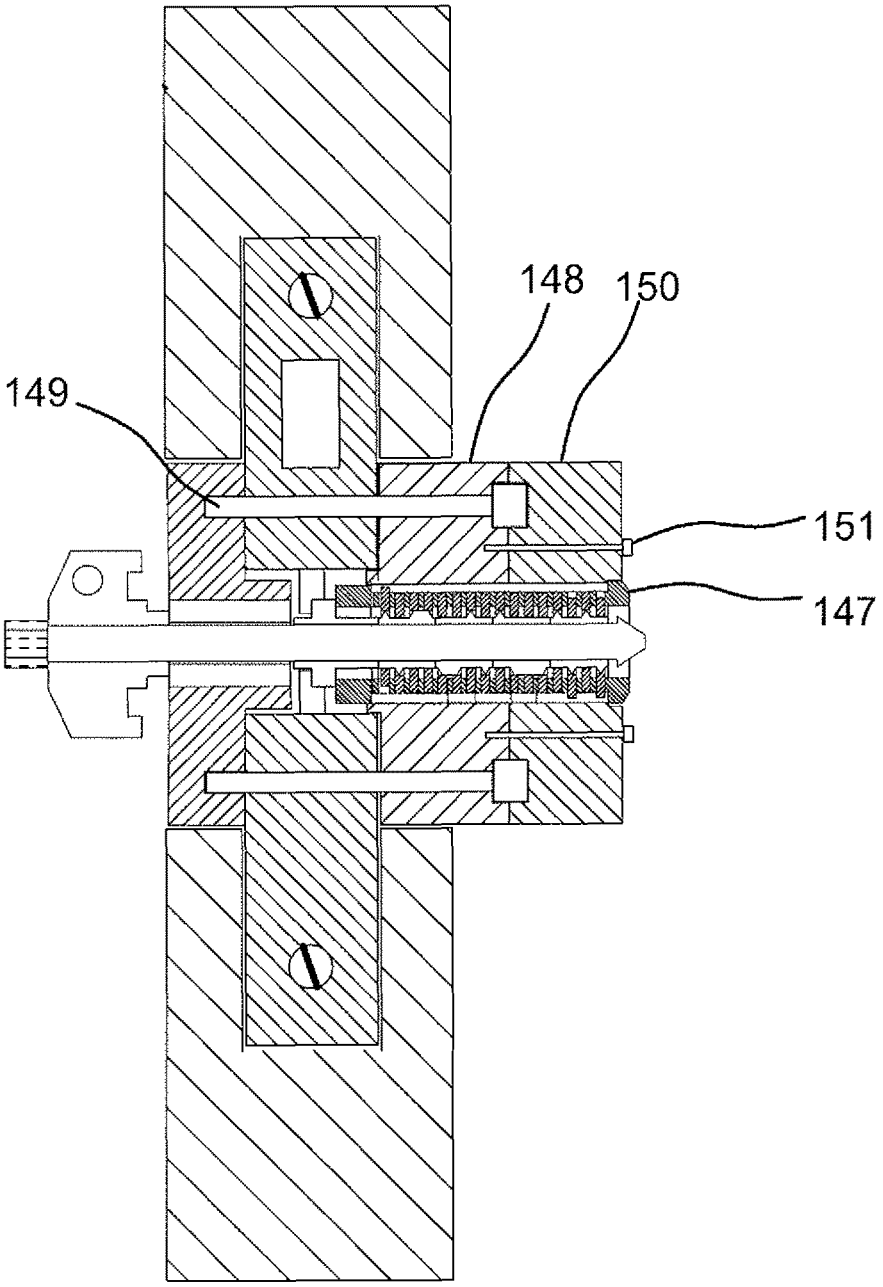
FIG. 21 shows an embodiment of a lock according to one aspect of the invention.

FIG. 21 shows a variant of a lock mounted in a protective manner which makes it more difficult to force the lock from the inside. According to this variant, the lock comprises a stator comprising an inner stator part 148 and an outer stator part 150. A rotor 147 extends through the inner stator part 148 and the outer stator part 150. The rotor 147 and the two stator parts 148, 150 are designed according to the embodiments described with reference to FIGS. 15, 17 and 19. Accordingly, the rotor 147 locks together the inner and outer stator parts 148, 150. The inner stator part 148 is attached to the lock case by means of bolts 149. The outer stator part 150 is attached to the inner stator part 148 by means of bolts 151. The outer stator part 150 prevents access to the bolts 149. By virtue of the fact that the rotor 150 locks together the inner stator part 143 and the outer stator part 150, the bolts 151 can be thinner than the bolts 149 without reducing the strength of the lock. The outer stator part 150 can thus be said to serve as a lid covering the inner stator part 143. This means that to gain access to the bolts 149, the rotor 147 must first be removed so that the stator parts 148, 150 can be separated. This operation requires a matching key. This design can thus be used to render the forcing from the inside of a lock mounted on the inside more difficult without the need to equip the lock with covering plates. This is an advantage since such covering plates, due to their small thickness, can often be forced without much difficulty.

This two-piece stator is made possible by the fact that the rotor is insertable in and removable from the stator. It is also possible to put together a stator from more than two parts. Accordingly, a long stator can be provided by joining together a plurality of stator parts. The design of the rotor thus enables the provision of a buildable stator.

As has been described with reference to FIG. 15, the rotor 100 is adapted for use in a stator comprising four channels. A stator of this type enables a rotor of the same design as the rotor 100 to be locked in four different orientations. This can be advantageous, in particular for use in locks for doors and hatches where there is not enough space for a lock case, such as in cabinet doors, desk drawers and chests. This will be explained in more detail below.

In pin tumbler locks of the traditional kind intended for use in desk drawers and cabinet doors, etc., the rear end of the rotor is usually provided with a sheet-metal plate or the like which is turned upon rotation of the rotor, thereby enabling locking of the drawer or the door. Furthermore, the stator of such a lock generally must have at least two separate pin channels comprising both springs and top pins to enable removal of the key in two different positions: One pin channel which enables the key to be removed from the lock when the sheet-metal plate is located in the position where it locks the cabinet, and one pin channel to enable the key to be removed from the lock when the sheet-metal plate is in the open position. For such traditional locks to be used in, for example, cabinet doors, two distinct, mirror-inverted types of locks must be designed for right-hand doors and left-hand doors, respectively. Basically, a right-hand lock can be used in a left-hand door, for example by changing the starting angle of the sheet-metal plate so that it points downwards and not to the right in the locked position. This requires, however, that there is a space at the base of the cabinet behind which the sheet-metal plate can be turned. This is not always the case. Cabinet doors, desk drawers and chest lids often require different orientations or positions of the sheet-metal plate for locking to occur. In view of the fact that known technology is limited to only two different positions, different locks must be manufactured to fit these different applications.

Figure 22:
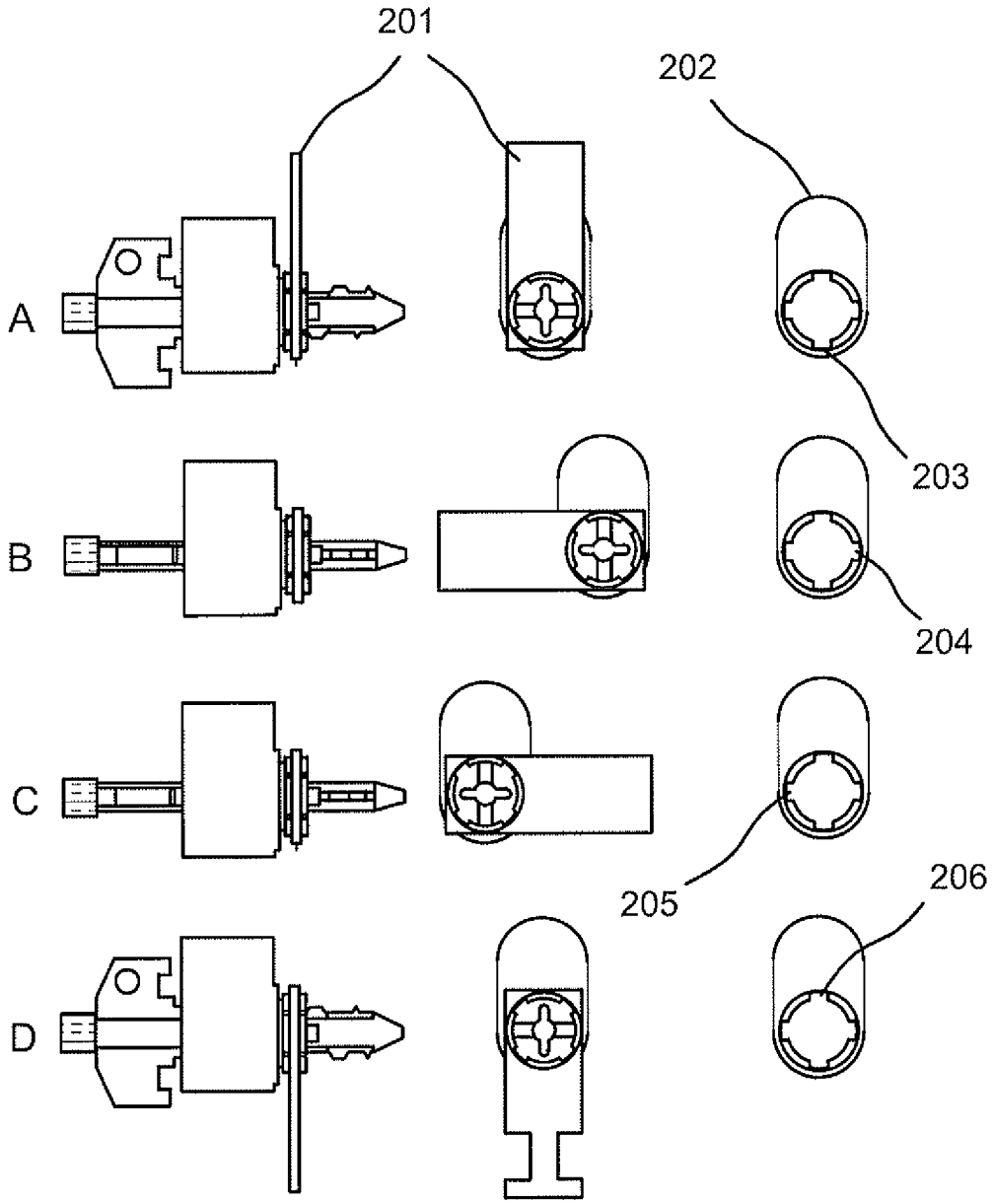
FIG. 22 shows an embodiment of a rotor and a stator according to one aspect of the invention.

FIG. 22 shows a lock 202 with a rotor. The rotor is of the same type as the rotor 100 in FIG. 15 and thus comprises a through-extending keyhole. A sheet-metal plate 201 is non-rotatably mounted on the rotor. In use, the sheet-metal plate can serve as a latch, thereby locking for instance a desk drawer, a cabinet door or a chest.

FIG. 22A illustrates, from left to right, the lock from the side, the same lock from behind, and indicates the channel 203 in which the projecting portions of the rotor elements are located when the sheet-metal plate 201 is pointing upwards according to FIG. 22A. The lock can be used, for example, as a lock for a desk drawer. When the sheet-metal plate is pointing upwards and no key or an incorrect key has been inserted in the rotor, at least one projection on the rotor elements is located in the channel 203 or in the opposite channel, where it prevents the rotor from rotating, which means that the desk drawer is locked.

FIG. 22B shows in a corresponding manner how the same lock is used instead in a left-handed cabinet door. When the sheet-metal plate is pointing to the right (as seen from the front) and no key or an incorrect key has been inserted in the rotor at least one projection on the rotor elements is located in the channel 204 and/or in the opposite channel, where it prevents the rotor from rotating, which means that the cabinet door is locked. The same is true when the same rotor is used instead in a right-handed cabinet door, as shown in FIG. 22C, and the sheet-metal plate points to the left in the locked position.

Finally, FIG. 22D shows how the same lock can instead be mounted in the lid of a chest, the roll-front of a cabinet or a louver door. As shown in FIG. 22D, the rotor can be provided to this end with a sheet-metal plate of a slightly different design. When the plate is oriented according to FIG. 22D and no key or an incorrect key has been inserted in the lock, at least one projection on the rotor elements is located in the channel 206 or in the opposite channel, which means that the lid is locked.

The 4-channel stator and the associated rotor can thus be used in locks for right-hand and left-hand cabinet doors, for desk drawers and for chest lids without any modifications to the stator or the rotor. This permits a single lock to be used in a number of different applications.

In FIG. 22D, the 4-channel stator has been exemplified in combination with a rotor having a through-extending keyhole. However, the 4-channel stator can also be used with a rotor without a through-extending keyhole, such as the rotor 2 according to Working Example 1.

According to a second further aspect of the invention, there is provided a mechanical or electromechanical lock with a stator and with a rotor which is rotatably disposed in the stator, which rotor for the purpose of cooperating with the stator comprises a number of elements adapted to be actuated by a key to enable unlocking, characterised in that all the elements in the rotor are designed to be moved, upon actuation, only a predetermined distance and that this distance is identical for each element, the elements being each arranged to assume, relative to the stator, either a blocking position as a result of no actuation or incorrect actuation, a releasing position as a result of correct actuation or a neutral, non-blocking position independently of whether actuation has occurred or not.

According to an embodiment of this second further aspect, the elements of the rotor are of two types, the first of which has the shape of pins with a central key opening and a first plane short side and a second short side with a locking lug projecting therefrom, which depending on the mounting position of the pin is arranged, when unactuated, to engage in a locking manner with a lower channel in the stator and, when correctly actuated, to be lifted out of the lower channel or, when unactuated, to be releasingly moved out of an upper channel in the stator and, when incorrectly actuated, to engage in a locking manner with this upper channel, and the second type of which has the shape of pins with a central key opening and two plane short sides without a locking lug, which pins therefore always assume a neutral, non-blocking position.

According to an embodiment of this second further aspect, the elements in the rotor have the shape of pins with a key opening and two short sides, which each have a projecting locking lug, wherein each pin is arranged to engage, by means of its locking lugs, with lower and upper permanently adjustable blocking elements arranged in pairs for each pin in such a manner that the pin, when unactuated and when the lower blocking element assumes an extended position and the upper blocking element assumes a retracted position, lockingly engages with the lower blocking element or, when correctly actuated, is releasingly lifted out of engagement therewith, wherein the pin when incorrectly actuated and when the upper blocking element assumes an extended position and the lower blocking element assumes a retracted position, lockingly engages with the upper blocking element and, when unactuated, is moved out of engagement therewith, and wherein the pin, whether actuated or not and when both the lower and the upper blocking element assume a retracted position, does not engage with any of the blocking elements, thus assuming a neutral, non-blocking position. According to an embodiment of this second further aspect, said blocking elements are electromagnetically actuatable.

According to an embodiment of this second further aspect the elements of the rotor have the shape of discs, which are rotatable in a bore formed in the rotor about a centre axis which extends through a central keyhole, wherein each disc has a first disc segment, with a radius corresponding to the radius of the bore, and adjacent to said first disc segment a radial notch, followed by a second disc segment, which spans an angular area roughly corresponding to the first disc segment but of smaller radius, and adjacent to the second disc segment a third disc segment, which spans an angular area roughly corresponding to the second disc segment and, starting from said segment, has a gradually increasing radius up to a radius corresponding to the radius of the bore, and adjacent to the third disc segment another radial notch, followed by a forth disc segment of smaller radius which extends to said first disc segment, the fourth disc segment spanning a greater angular area than the other three disc segments together, wherein an arm is arranged in the rotor and adapted, in cooperation with the radially high portions of the first and the third disc segments, to lockingly engage with a channel in the stator and, in cooperation with the radially low portion of the second disc segment, to cause the arm to disengage from said channel, wherein the angular positions of the discs are mutually adjustable so that when the discs are rotated by an angle which corresponds to the angle spanned by said second disc segment, certain discs, for the purpose of locking, can be brought into abutment against or, for the purpose of unlocking, be moved away from the arm, certain discs, for the purpose of unlocking, can be moved away from or, for the purpose of locking, can be brought into abutment against the arm and certain discs can permanently assume a neutral and, thus, unlocking position moved away from the arm.

According to an embodiment of this second further aspect, there is provided a key for a lock according to any one of the preceding embodiments, which is characterised in that the profile of the key is buildable using at least two different dimensions, the first dimension of which is arranged to actuate elements in the lock which must be actuated to enable locking/unlocking, as well as any neutral elements, and the second dimension or other dimensions of which are arranged not to actuate any elements in the lock, such that the relative order of actuating and non-actuating dimensions form a key profile which can be directly translated into a binary code or, inversely, such that a binary code is translatable into a matching key profile.

According to an embodiment of this second further aspect, the key comprises, for each element in the rotor, a key member, which is arranged either to actuate an element which is to be actuated to enable unlocking or not to actuate an element which is not to be actuated to enable unlocking, or optionally to actuate or not actuate a neutral element.

According to an embodiment of this second further aspect, the key is adjustable by mounting different loose key members in a non-rotating manner on a key core body.

According to an embodiment of this second further aspect, the loose key members are divided into groups, which are intended to cooperate with a plurality of elements arranged successively in the rotor.

According to an embodiment of this second further aspect, the groups are hexadecimally coded.

The different aspects of the invention can be more readily understood in the light of the following definitions:

Mechanical lock: a lock which can be opened with a mechanical key only.

Mechanical key: a key which utilizes its physical shape to open a lock.

Mechanical key code: a description of the physical shape of the key that is required to open a lock.

Separate lock: a lock which is not part of a lock system.

System lock: a lock which is part of a lock system.

Lock system: a group of locks including at least two locks with different mechanical lock codes and at least one common key.

Mechanical blocking system: a system comprising a mechanical lock and a mechanical key.

Mechanical individually keyed lock: a mechanical lock that matches one mechanical key code only.

Mechanical lock code: a description of a mechanical individually keyed lock, a mechanical configuration, i.e. the manner in which the elements of the lock that are actuated by the key are arranged so as to define a criterion for opening of the lock that can only be met by mechanical actuation. In other words, the mechanical lock code determines which mechanical key code is required to open the lock.

Single-code key: a key which can open mechanically individually keyed locks only.

Mechanical system-coded lock: a mechanical lock in which at least two differently mechanically coded keys will fit.

Mechanical system lock code: a designation of the mechanical settings of a system-coded lock, i.e. the manner in which the elements of the lock that are actuated by the key are arranged so as to define the different criteria for opening of the lock that can only be met by mechanical actuation. The mechanical system lock code defines which of the different keys that will open a separate system-coded mechanical lock.

Mechanical system key: a key which may open locks having different mechanical lock codes.

Master key: a mechanical system key which will open all the locks of a lock system.

Mechanical variable lock: locks which, when manufactured, differ from each other because the lock code is set during manufacture. This lock code cannot be changed by the user.

Mechanical unitary lock: locks which, when manufactured, do not differ from each other as no original mechanical lock code is set during the actual manufacture, but instead afterwards by the user.

Mechanical manually readjustable lock: a mechanical lock whose mechanical lock code or lock codes can be changed by a layman without the need for special tools.

Mechanical remote-controlled readjustable lock: a mechanical lock whose mechanical lock code or codes can be changed for example by means of some kind of remote control, without manually manipulating the lock.

Mechanical lock system code: a compilation of all the mechanical lock codes for the locks included in a lock system.

Mechanical key system code: a description of all the key codes of a lock system.

Code terminology: the language describing mechanical lock and key codes.

The invention claimed is:

1. A key which has a body along which a plurality of projections are arranged, said plurality of projections all being arranged in a common plane and said plurality of projections all having the same vertical height from the body of the key and defining together a profile of the key, wherein the key has a plurality of key elements being arranged along the body of the key, on which key elements said projections are disposed, defining the profile of the key, wherein the key is buildable from said key elements, wherein the key elements are arranged in a central groove of the body of the key, from which each of the key elements has a downwardly oriented element profile and an upwardly oriented element profile, wherein two or four different element profiles can be obtained from each one of key elements by turning the one key element vertically or horizontally so that when the one key element is turned about its vertical axis both the downwardly oriented element profile and the upwardly oriented element profile are reversed, and turning the one key element about its horizontal axis gives the one key element a new upper element profile and a new lower element profile, and wherein each of the key elements has projections for two or four different element profiles.

2. The key according to claim 1, wherein the key comprises a plurality of projections in two opposite directions along the key body.

3. The key according to claim 2, wherein for each projection there is an associated position on the key body and wherein the position of each projection is unique.

4. A lock-key combination comprising the key of claim 1 and a lock including an arrangement for a lock, comprising:

a stator, a rotor having a longitudinal direction and which is rotatably arranged in the stator, the stator having at least two parallel channels in a longitudinal direction of the stator, and the rotor having at least two projections that are arranged so that in a locked and unrotated position the projections prevent the rotor from being removed from the stator, and so that in an unlocked and rotated position the projections allow the rotor to be removed from the stator by passing the channels, a set of elements arranged in said rotor for cooperating with the stator, which elements each have an opening and which elements are arranged successively in the longitudinal direction of the rotor and the openings of which together form a through hole adapted for receiving a key, each of said elements being arranged to be movable within the rotor in a direction perpendicular to the longitudinal direction of the rotor by force of gravity and actuation by the key, each of said elements being readjustably arranged, independently of the others, between a first state during which actuation by the key of said element results in a blocking position wherein said element prevents rotation of the rotor, and a second state during which the actuation by the key results in a releasing position wherein said element allows rotation of the rotor, wherein said element in said first state allows rotation of the rotor in absence of any mechanical actuation, and wherein said element in said second state prevents rotation of the rotor in absence of the actuation.

* * * * *